US007878723B2

(12) United States Patent
Igarashi et al.

(10) Patent No.: US 7,878,723 B2
(45) Date of Patent: Feb. 1, 2011

(54) PRINTING APPARATUS AND METHOD OF CONTROLLING TRANSPORT OF PRINT MEDIA FOR CONTINUOUS PRINTING

(75) Inventors: Hitoshi Igarashi, Shiojiri (JP); Takuya Yasue, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 825 days.

(21) Appl. No.: 11/897,031

(22) Filed: Aug. 29, 2007

(65) Prior Publication Data

US 2008/0056798 A1 Mar. 6, 2008

(30) Foreign Application Priority Data

Aug. 29, 2006 (JP) ..... 2006-231675

(51) Int. Cl.
*B41J 13/00* (2006.01)
*B41J 2/01* (2006.01)
*B41J 11/44* (2006.01)

(52) U.S. Cl. ..... 400/582; 400/578; 347/101; 347/104

(58) Field of Classification Search ..... 347/101, 347/104; 400/582, 578; 399/361–407; *B41J 2/01, B41J 13/00, 11/44; B65H 5/06*
See application file for complete search history.

(56) References Cited

U.S. PATENT DOCUMENTS 5,674,019 A * 10/1997 Munakata et al. ..... 400/568
5,951,180 A * 9/1999 Kawaura ..... 400/629
6,168,333 B1 * 1/2001 Merz et al. ..... 400/634
6,471,428 B2 * 10/2002 Iwasaki et al. ..... 400/582
6,530,569 B2 * 3/2003 Yamagishi ..... 271/270
6,983,686 B2 * 1/2006 Vaughn et al. ..... 101/32
2006/0024113 A1 * 2/2006 Saito et al. ..... 400/578
2006/0193672 A1 * 8/2006 Saito et al. ..... 400/582

FOREIGN PATENT DOCUMENTS

JP 10017177 A * 1/1998
JP 11268844 A * 10/1999
JP 11-300950 A 11/1999
JP 11300950 A * 11/1999
JP 2001019233 A * 1/2001

(Continued)

*Primary Examiner*—Judy Nguyen
*Assistant Examiner*—'Wyn' Q Ha
(74) *Attorney, Agent, or Firm*—John J. Penny, V; Nutter McClennen & Fish LLP

(57) ABSTRACT

A printing apparatus, including a first roller and a second roller, adapted to transport a plurality of print media on a tray in a transport direction, the second roller disposed at a downstream side, the first roller disposed at an upstream side, includes: a first calculator, operable to calculate a first transport amount for the first roller; a second calculator, operable to calculate, based on the first transport amount, a second transport amount for the second roller, the second transport amount being greater than the first transport amount; a first controller, operable to drive a first motor that drives the first roller and to stop the first motor such that the first roller stops with the first transport amount; and a second controller, operable to drive a second motor that drives the second roller when the first controller drives the first motor and to stop the second motor such that the second roller stops with the second transport amount.

4 Claims, 8 Drawing Sheets

FOREIGN PATENT DOCUMENTS

| | | | | |
|---|---|---|---|---|
| JP | 2003-072964 | | | 3/2003 |
| JP | 2003072964 | A | * | 3/2003 |
| JP | 2004196483 | A | * | 7/2004 |
| JP | 2006036490 | A | * | 2/2006 |
| JP | 2006-117385 | | | 5/2006 |

* cited by examiner

PAPER FEED PROCESSING FLOW CHART
CASE OF REAR PAPER FEED

PAPER TRANSPORTING PROCESSING FLOW CHART
CASE OF REAR PAPER FEED

PAPER DISCHARGE PROCESSING FLOW CHART
CASE OF REAR PAPER FEED

FIG. 7

| | SYNCHRO (TRACING) CONTROL | SIMULTANEOUS DRIVING CONTROL |
|---|---|---|
| A. DRIVING TIMING | 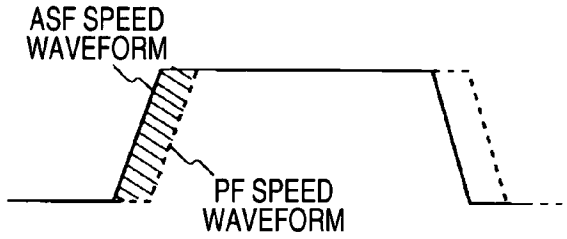  | 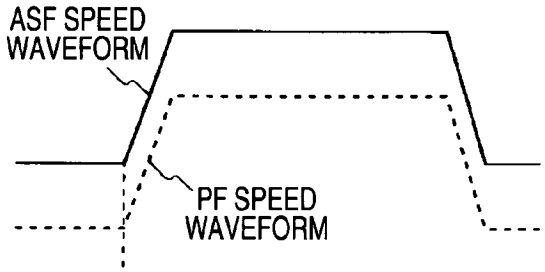  |
| B. TRANSPORT AMOUNT CORRECTION | ASF TARGET TRANSPORT AMOUNT (NUMBER OF PULSES) INSTRUCTED = PF TARGET TRANSPORT AMOUNT (NUMBER OF PULSES) INSTRUCTED x 1.05 | NONE (ASF TARGET TRANSPORT AMOUNT AND PF TARGET TRANSPORT AMOUNT ARE CALCULATED SEPARATELY) |
| C. TRACING CONTROL | ASF TARGET TRANSPORT AMOUNT INSTRUCTED IS DETERMINED ON THE BASIS OF PF ABSOLUTE TRANSPORT AMOUNT AND THE LIKE | ASF TARGET TRANSPORT AMOUNT INSTRUCTED IS DETERMINED ON THE BASIS OF ASF ABSOLUTE TRANSPORT AMOUNT AND THE LIKE |
| D. PAPER FEED POSITION | PAPER FEED POSITION OF SECOND OR SUBSEQUENT PRINT MEDIUM IS DETERMINED ON THE BASIS OF ASF TRANSPORT AMOUNT AFTER PE DETECTION | PAPER FEED POSITION IS ALWAYS DETERMINED ON THE BASIS OF ASF TRANSPORT AMOUNT AFTER PE DETECTION |

FIG. 8

EXAMPLE OF PAPER TRANSPORTING CONTROL IN SYNCHRO (TRACING) CONTROL
ASF TARGET TRANSPORT AMOUNT = PF TARGET TRANSPORT AMOUNT

| NUMBER OF CONTROLS | PAPER TRANSPORT AMOUNT | ACCUMULATED PAPER TRANSPORT AMOUNT | PF TARGET TRANSPORT AMOUNT | ACTUAL PF TRANSPORT AMOUNT | PF ABSOLUTE TRANSPORT AMOUNT (ACCUMULATED VALUE) | ASF TARGET TRANSPORT AMOUNT | ACTUAL ASF TRANSPORT AMOUNT | ASF ABSOLUTE TRANSPORT AMOUNT (ACCUMULATED VALUE | DIFFERENCE BETWEEN TRANSPORT AMOUNTS IN EACH TRANSPORT CONTROL |
|---|---|---|---|---|---|---|---|---|---|
| 1 | 100 | 100 | 100 | 98 | 98 | 100 | 101 | 101 | 3 |
| 2 | 100 | 200 | 102 | 99 | 197 | 102 | 100 | 201 | 1 |
| 3 | 100 | 300 | 103 | 102 | 299 | 103 | 99 | 300 | -3 |
| 4 | 100 | 400 | 101 | 100 | 399 | 101 | 100 | 400 | 0 |
| 5 | 100 | 500 | 101 | 60 | 459 | 101 | 99 | 499 | 39 |
| 6 | 100 | 600 | 141 | 140 | 599 | 141 | 140 | 639 | 0 |

ASF TARGET TRANSPORT AMOUNT IS CAUSED TO FOLLOW PF TARGET TRANSPORT AMOUNT

EXAMPLE OF PAPER TRANSPORTING CONTROL IN SIMULTANEOUS DRIVING CONTROL
ASF TARGET TRANSPORT AMOUNT ≠ PF TARGET TRANSPORT AMOUNT

| NUMBER OF CONTROLS | PAPER TRANSPORT AMOUNT | ACCUMULATED PAPER TRANSPORT AMOUNT | PF TARGET TRANSPORT AMOUNT | ACTUAL PF TRANSPORT AMOUNT | PF ABSOLUTE TRANSPORT AMOUNT (ACCUMULATED VALUE) | ASF TARGET TRANSPORT AMOUNT | ACTUAL ASF TRANSPORT AMOUNT | ASF ABSOLUTE TRANSPORT AMOUNT (ACCUMULATED VALUE | DIFFERENCE BETWEEN TRANSPORT AMOUNTS IN EACH TRANSPORT CONTROL |
|---|---|---|---|---|---|---|---|---|---|
| 1 | 100 | 100 | 100 | 98 | 98 | 100 | 100 | 100 | 2 |
| 2 | 100 | 200 | 102 | 99 | 197 | 100 | 101 | 201 | 2 |
| 3 | 100 | 300 | 103 | 102 | 299 | 99 | 98 | 299 | -4 |
| 4 | 100 | 400 | 101 | 100 | 399 | 101 | 100 | 399 | 0 |
| 5 | 100 | 500 | 101 | 60 | 459 | 101 | 101 | 500 | 41 |
| 6 | 100 | 600 | 141 | 140 | 599 | 100 | 100 | 600 | -40 |

OCCURRENCE OF BACK TENSION

CALCULATION IS MADE ON THE BASIS OF ASF ABSOLUTE TRANSPORT AMOUNT

PRINTING APPARATUS AND METHOD OF CONTROLLING TRANSPORT OF PRINT MEDIA FOR CONTINUOUS PRINTING

BACKGROUND

1. Technical Field

The present invention relates to a printing apparatus and a method of controlling transport of print media for continuous printing.

2. Related Art

As an ink jet printer that performs printing on a print medium, such as a regular paper, there is a printer including an LD (load) roller serving to supply a print medium to the inside of the printer and a PF (paper feed) roller serving to transport the print medium supplied to the inside of the printer (for example, refer to JP-A-2003-72964 and JP-A-2006-117385).

In a printer disclosed in JP-A-2003-72964, an LD roller is connected to a PF motor, which drives a PF roller to rotate, through a clutch and may be disconnected from the PF motor. In the printer disclosed in JP-A-2003-72964, a print medium set on a paper feed tray is transported up to the PF roller by the LD roller connected to the PF motor. When the print medium is transported up to the PF roller, the LD roller and the PF motor are disconnected from each other. The printer disclosed in JP-A-2003-72964 transports the print medium, which has been transported up to the PF roller, using the PF roller.

In a printer disclosed in JP-A-2006-117385, an LD roller and a PF roller are rotatably driven by separate motors, respectively. That is, the LD roller is rotatably driven by an ASF (automatic sheet feeder) motor, and the PF roller is rotatably driven by a PF motor. Also in the printer disclosed in JP-A-2006-117385, a print medium is transported up to the PF roller by the LD roller and is then transported by the PF roller.

In a printer, it is requested to improve a throughput. The throughput is expressed as the maximum print number of sheets per unit time.

However, in the printer disclosed in JP-A-2003-72964, for every print medium, it is necessary to cause the LD roller to be connected to the PF motor through the clutch and perform a transporting operation using the PF roller in a state where the clutch is disconnected after rotating the LD roller. In addition, also in the printer disclosed in JP-A-2006-117385, for every print medium, it is necessary to transport a print medium using the LD roller and then perform a transporting operation using the PF roller. That is, a paper feed operation and an operation from printing to paper discharge after the paper feed operation are separate operations. Accordingly, when continuously printing a plurality of print media, the above operations should be repeatedly executed in the order. Due to a limitation on such control operation, there is a limit in improving the throughput in the printers disclosed in JP-A-2003-72964 and JP-A-2006-117385.

Accordingly, in order to overcome the limitation on such control operation, it is considered to keep driving the LD roller and the PF roller at the same time such that a plurality of print media are continuously transported. However, in the case of driving the LD roller and the PF roller at the same time, there is a possibility that, for example, the following problem will occur.

If an actual transport amount by which the PF roller transports the print medium becomes greater than an actual transport amount by which the LD roller transports the print medium, a state of a print medium after being transported changes such that the print medium is pulled between the PF roller and the LD roller, as compared with a state of the print medium before being transported. Due to the change in the pulling direction, a so-called back tension that causes the print medium to be pulled from the PF roller side to the LD roller side acts on the print medium.

In addition, the posture of the print medium on which the back tension acts with respect to the transport direction changes to cause a slanting transport or the actual transport amount of the print medium at the time of completion of the transport control becomes smaller than a target transport amount, according to an action of the back tension. The transporting precision of the print medium is lowered. In addition, damage occurs in the print medium on which the back tension acts or a pulling sound of the print medium occurs.

SUMMARY

An advantage of some aspects of the invention is to provide a printing apparatus and a method of controlling transport of print media for continuous printing capable of continuously transporting a plurality of print media by driving an upstream-side transporting roller and a downstream-side transporting roller together while making it difficult that a back tension acts on the print media.

According to an aspect of the present invention, there is provided a printing apparatus, including a first roller and a second roller, adapted to transport a plurality of print media on a tray in a transport direction, the second roller disposed at a downstream side of the tray in the transport direction, the first roller disposed at a downstream side of the second roller in the transport direction, the printing apparatus comprising:

a first calculator, operable to calculate a first transport amount for the first roller;

a second calculator, operable to calculate, based on the first transport amount, a second transport amount for the second roller, the second transport amount being greater than the first transport amount;

a first controller, operable to drive a first motor that drives the first roller and to stop the first motor such that the first roller stops with the first transport amount; and a second controller, operable to drive a second motor that drives the second roller when the first controller drives the first motor and to stop the second motor such that the second roller stops with the second transport amount.

The present disclosure relates to the subject matter contained in Japanese patent application No. 2006-231675 filed on Aug. 29, 2006, which is expressly incorporated herein by reference in its entirety.

BRIEF DESCRIPTION OF THE DRAWINGS

The invention will be described with reference to the accompanying drawings, wherein like numbers reference like elements.

FIG. 7 is a view illustrating a comparison table of features of a synchro (tracing) control and features of a simultaneous driving control.]

FIG. 8 is a view explaining a difference between the synchro (tracing) control and the simultaneous driving control.

DESCRIPTION OF EXEMPLARY EMBODIMENTS

Hereinafter, a printing apparatus and a method of controlling transport of print media for continuous printing according to embodiments of the invention will be described with reference to the accompanying drawings. A printing apparatus will be described using an ink jet printer as an example. The method of controlling transport of print media for continuous printing will be described as a part of an operation of the ink jet printer.

Figure 1:
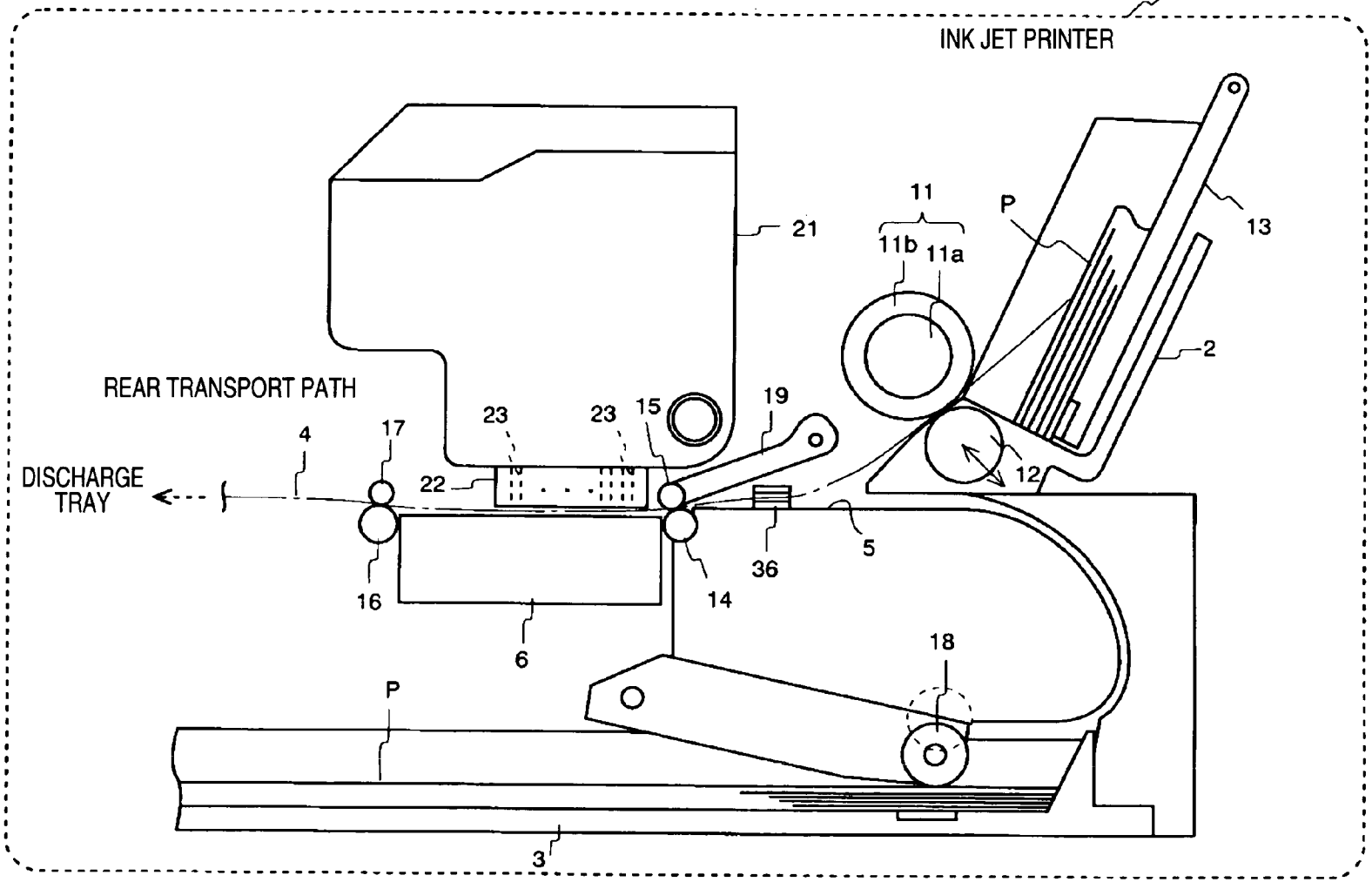
FIG. 1 is a side view illustrating an ink jet printer according to an embodiment of the present invention.

FIG. 1 is a side view illustrating parts of the mechanical structure of an ink jet printer 1 according to an embodiment of the present invention.

The ink jet printer 1 includes a rear feed tray 2 and a front feed tray 3. The rear feed tray 2 is provided in a rear part of the ink jet printer 1 so as to protrude upward. The front feed tray 3 is provided approximately horizontally in a bottom part of the ink jet printer 1. Various kinds of print media P, such as regular paper, glossy paper, photo paper, postcard paper, and L photo paper, may be placed in the rear feed tray 2 and the front feed tray 3.

The print media P placed in the rear feed tray 2 and the front feed tray 3 are transported along a predetermined transport path and are transported to a discharge tray (not shown) provided at a front side of the ink jet printer 1. In FIG. 1, a rear transport path 4, which indicates the direction in which print media are transported, is shown in a dashed-dotted line. A guide member 5 that regulates the transport direction of the print media P, a platen 6, and the like are provided along the rear transport path 4.

The ink jet printer 1 includes as mechanical members for transporting the print media P placed in the rear feed tray 2, an LD (load) roller 11, an LD follower roller 12, and a hopper 13; and a PF (paper feed) roller 14, a PF follower roller 15, a discharge roller 16, and a discharge follower roller 17. In addition, the ink jet printer 1 includes a second LD roller 18 as a mechanical member for transporting the print media P placed in the front feed tray 3.

The LD roller 11 is provided to be rotatable in a state where the LD roller 11 is adjacent to a lower end edge of the rear feed tray 2. The LD roller 11 includes a roller shaft 11*a* having an axis perpendicular to the plane of FIG. 1 and a rubber member 11*b* provided along the periphery of the roller shaft 11*a*. The outer periphery of the LD roller 11 has an approximately circular shape. The LD roller 11 rotates by driving of an ASF (automatic sheet feeder) motor 32, which will be described later.

The LD follower roller 12 has a cylindrical shape having approximately the same width as the LD roller 11 and is provided below the LD roller 11 so as to be rotatable. The LD follower roller 12 moves in the direction, in which the LD follower roller 12 is in contact with or spaced apart from the LD roller 11, by driving of an ASF sub-motor 33 which will be described later. The LD roller 11 and the LD follower roller 12 are in contact with each other in the position near the lower end edge of the rear feed tray 2. The LD roller 11 and the LD follower roller 12 are pressed against each other by a predetermined pressure.

The hopper 13 is provided such that a lower part side of the rear feed tray 2 swings. The hopper 13 changes the position so as to approach the LD roller 11 when the LD follower roller 12 is pressed against the LD roller 11 and changes the position so as to be spaced apart from the LD roller 11 when the LD follower roller 12 is spaced apart from the LD roller 11. In the case when the print media P are placed in the rear feed tray 2, a lower end of the uppermost print medium P is in contact with the LD roller 11 when the hopper 13 approaches the LD roller 11. Thereby, the print medium P on the rear feed tray 2 is inserted between the hopper 13 and the LD roller 11.

The PF roller 14 is provided below the rear transport path 4 between the guide member 5 and the platen 6. The PF roller 14 is formed in the cylindrical shape using a metallic material and is rotatably disposed such that the cylindrical axis direction of the PF roller 14 is approximately perpendicular to the plane of FIG. 1. In addition, ceramic particles for stopping sliding are adhered on an outer peripheral surface of a cylinder-shaped metal rod so as to form unevenness. Thus, the PF roller 14 rotates by driving of a PF motor 31 which will be described later.

The PF follower roller 15 has a cylindrical shape having approximately the same width as the PF roller 14 and is provided above the PF roller 14 so as to be rotatable. The PF follower roller 15 is held by a PF follower roller arm 19. An urging force that acts downward in FIG. 1 is applied to the PF follower roller arm 19 by a wound spring (not shown). The PF follower roller 15 is pressed against the PF roller 14 with high pressure.

Accordingly, a transport capability (total transport capability including a holding force or the like) of the print medium P obtained by the PF roller 14 and the PF follower roller 15 that are pressed against each other is greater than that of the print media P obtained by the LD roller 11 and the LD follower roller 12 that are pressed against each other. In the case when a sheet of print medium P is nipped between the PF roller 14 and the PF follower roller 15 and nipped between the LD roller 11 and the LD follower roller 12, the transport amount of the print media P corresponds to the amount controlled by the PF roller 14 and the PF follower roller 15.

The discharge roller 16 is provided below the rear transport path 4 between the platen 6 and a discharge tray (not shown). The discharge roller 16 rotates by driving of the PF motor 31 which will be described later.

The discharge follower roller 17 is rotatably provided above the discharge roller 16. The discharge follower roller 17 is pressed against the discharge roller 16 with low pressure.

Further, the ink jet printer 1 includes a printing mechanism that performs printing by ejecting ink onto the print media P, such as a carriage 21, in addition to the above mechanisms for transporting the print media P.

The carriage 21 is provided above the platen 6 so as to be able to move in the direction perpendicular to the plane of FIG. 1. Within the carriage 21, for example, an in-tank (not shown) is provided The carriage 21 moves in the direction perpendicular to the plane of FIG. 1 by driving of a CR (carriage) motor (not shown).

On a lower surface of the carriage 21, a recording head 22 is provided so as to face the platen 6. The recording head 22 has a plurality of ink ejecting nozzles 23. Ink is supplied from the in-tank to the plurality of ink ejecting nozzles 23. The plurality of ink ejecting nozzles 23 are arrayed along the transport direction of the print media P. A piezoelectric element (not shown) is provided within each of the ink ejecting nozzles 23. The piezoelectric element deforms depending on a voltage applied. If the piezoelectric element deforms, an amount of ink corresponding to the deformation is extruded from the ink ejecting nozzle 23 and is ejected from the ink ejecting nozzle 23. The ink ejected from the plurality of ink ejecting nozzles 23 adheres to a portion of the print media P positioned between the platen 6 and the recording head 22.

By applying a voltage having a waveform corresponding to print data to the plurality of piezoelectric elements while the carriage 21 is moving in the direction perpendicular to the plane of FIG. 1, it is possible to cause ink to adhere to a portion of the print media P positioned between the platen 6 and the recording head 22 in correspondence with the print data. The ink jet printer 1 can print an image based on print data on the print media P by repeatedly executing the printing processing and paper transporting processing for transporting the print media P by a predetermined amount.

Figure 2:
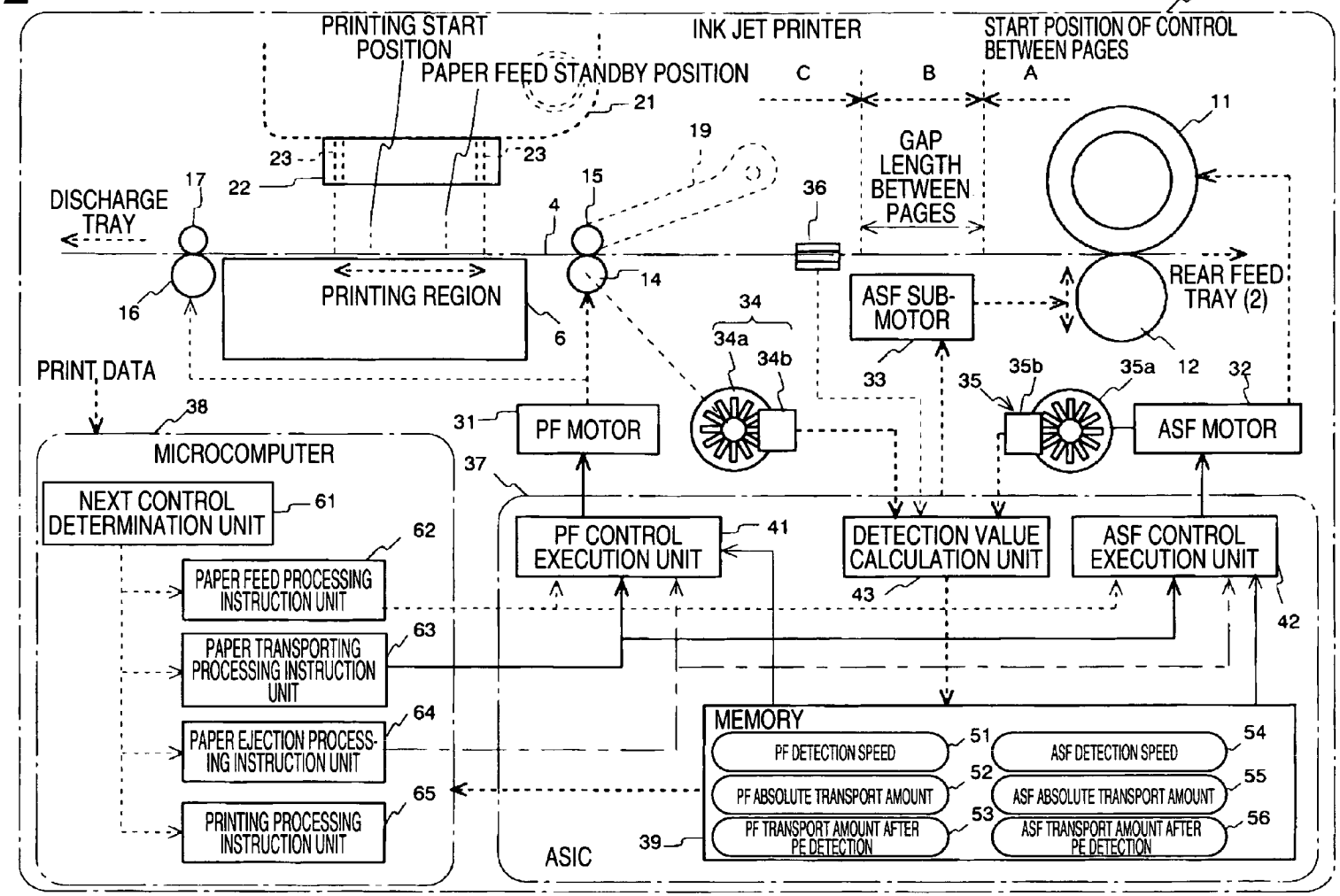
FIG. 2 is a block diagram illustrating a control system of the ink jet printer shown in FIG. 1.

FIG. 2 is a block diagram illustrating the configuration of a part of a control system of the ink jet printer 1 shown in FIG. 1. In addition, the rear transport path 4 and various kinds of mechanical members disposed along the path are schematically shown in an upper part of FIG. 2. In the rear transport path 4, a start position of control between pages, a paper feed standby position, a printing start position, and the like are set as reference positions for control.

The start position of control between pages is set between the LD roller 11 and the PF roller 14. The start position of control between pages is a reference position for executing a control for securing a predetermined gap length (spacing) between pages of two sheets of print media P, which are continuously transported, in a case when the plurality of print media P placed in the rear feed tray 2 is continuously transported. When a leading end edge of the next print medium P that is continuously transported arrives at the start position of control between pages, the transport of the next print medium P is stopped. When a trailing end edge of the print media P that is continuously transported is spaced apart from the start position of control between pages by a predetermined gap length between pages, the transport of the next print medium P starts again. Through the control between pages, the spacing corresponding to the gap length between pages can be secured between the plurality of print media P transported continuously.

The paper feed standby position is a stopping target position of the leading end edge of the print medium P in the normal paper feed processing. The paper feed standby position is set at the position that is separated by a predetermined distance (for example, 3 to 5 millimeters) downward from one of the plurality of ink ejecting nozzles 23 formed in the recording head 22, the one being positioned at the most upstream side (rear feed tray 2 side) of the transport direction of the print media P.

The printing start position is a stopping target position of a leading end edge of the print media P when starting processing for printing the print media P. The printing start position is set at the position that is separated by a predetermined distance (for example, 3 to 5 millimeters) upward from one of the plurality of ink ejecting nozzles 23 formed in the recording head 22, the one being positioned at the most downstream side (discharge tray side) of the transport direction of the print media P.

Thus, since the paper feed standby position is set at the upstream side of the transport direction of the print media P compared with the printing start position, the print media P stops at the paper feed standby position and is then fed to the printing start position in the normal paper feed processing. Therefore, it is possible to improve the precision of the stopping position of the print media P with respect to the printing start position as compared with a case in which the print media P is transported from the rear feed tray 2 to the printing start position at a time by one control.

In addition to the PF motor 31 for driving the PF roller 14 and the discharge roller 16 described above such that the PF roller 14 and the discharge roller 16 rotate, the ASF motor 32 for driving the LD roller 11 such that the LD roller 11 rotates, the ASF sub-motor 33 for causing the LD follower roller 12 to be in contact with or spaced apart from the LD roller 11, and the CR motor (not shown), a PF rotary encoder 34, an ASF rotary encoder 35, a PE (paper edge) sensor 36 serving as a sensor, an ASIC (application specific integrated circuit) 37, a microcomputer 38, and the like.

In addition, pulse motors, such as a DC (direct current) motor and a stepping motor, may be used as the PF motor 31, the ASF motor 32, the ASF sub-motor 33, and the CR motor. The DC motor rotates at rated speed when a predetermined DC voltage is applied. The DC motor rotates at the speed corresponding to a duty ratio lower than the rated speed if a voltage applied is controlled by the PWM (pulse width modulation). Moreover, the DC motor rotates in the opposite direction when the direction of a DC voltage is reversed.

The PF rotary encoder 34 includes a PF scale plate 34*a* that rotates together with the PF roller 14 and a PF photointerrupter 34*b* that detects a plurality of slits formed along the outer periphery of the PF scale plate 34*a*. When the PF scale plate 34*a* rotates together with the PF roller 14, the PF photointerrupter 34*b* of the PF rotary encoder 34 generates a detection signal whose level changes corresponding to detection of a slit. The detection signal becomes a pulse waveform. A pulse period of the detection signal changes in accordance with the rotational speed of the PF scale plate 34*a*. For example, if the rotational speed of the PF scale plate 34*a* increases, the pulse period of the detection signal becomes short.

The ASF rotary encoder 35 includes an ASF scale plate 35*a* that rotates together with the ASF motor 32 and an ASF photointerrupter 35*b* that detects a plurality of slits formed along the outer periphery of the ASF scale plate 35*a*. The rotation amount of a rotor of the ASF motor 32 is related with the rotation amount of the LD roller 11. The rotation amount of the ASF scale plate 35*a* may correspond to the rotation amount of the LD roller 11. When the ASF scale plate 35*a* rotates together with the ASF motor 32 and the LD roller 11, the ASF photointerrupter 35*b* of the ASF rotary encoder 35 generates a detection signal whose level changes corresponding to detection of a slit.

In the PE sensor 36, a light-emitting element and a light-receiving element (not shown) are provided opposite to each other at a predetermined spacing therebetween. The PE sensor 36 is disposed such that the rear transport path 4 is positioned between the light-emitting element and the light-receiving element. The PE sensor 36 is provided at the position that is separated, by a distance equal to or larger than at least the gap length between pages, downward from the start position of control between pages between the LD roller 11 and PF roller 14. The light-receiving element of the PE sensor 36 outputs a detection signal that changes in accordance with the light receiving state of light emitted from the light-emitting element. The PE sensor 36 outputs a detection signal that changes depending on whether or not the print media P exist between the light-emitting element and the light-receiving element.

The ASIC 37 is a kind of a microcomputer and includes a memory 39, a CPU (central processing unit), a timer, an input/output port, and the like, which are not shown). A detection signal of the PF rotary encoder 34, a detection signal of the ASF rotary encoder 35, a detection signal of the PE sensor 36, and the like are input to the input/output port. When the CPU (not shown) executes a predetermined program, a PF control execution unit 41, an ASF control execution unit 42, a detection value calculation unit 43, and the like are realized in the ASIC 37.

The memory 39 stores various kinds of detection data used for control of the ink jet printer 1. The detection data stored in the memory 39 includes, for example, a PF detection speed 51, a PF absolute transport amount 52, a PF transport amount after PE detection 53, an ASF detection speed 54, an ASF absolute transport amount 55, and an ASF transport amount after PE detection 56, and the like.

The microcomputer 38 includes a memory, a CPU, a timer, an input/output port, and the like, which are not shown. The input/output port of the microcomputer 38 is connected to the input/output port of the ASIC 37 and the like. When the CPU (not shown) executes a predetermined program, a next control determination unit 61, a paper feed processing instruction unit 62, a paper transporting processing instruction unit 63, a paper discharge processing instruction unit 64, a printing processing instruction unit 65, and the like are realized in the microcomputer 38.

In addition, a program executed by the CPU of the ASIC 37 may be stored in the memory 39 of the ASIC 37, for example. A program executed by the CPU of the microcomputer 38 may be stored in a memory of the microcomputer 38, for example. Moreover, these programs or a part of the programs may be stored in the memories before shipment of the ink jet printer 1 or may be stored in the memories after shipment of the ink jet printer 1. The programs or a part of the programs stored in the memories after shipment of the ink jet printer 1 may be read from a computer-readable recording medium, such as a CD-ROM, and then written into the memory using a personal computer connected to the ink jet printer 1. Alternatively, the programs or a part of the programs stored in the memories after shipment of the ink jet printer 1 may be downloaded from a server through a transmission medium, such as Internet, and then written into the memory using a personal computer connected to the ink jet printer 1.

The detection value calculation unit 43 realized in the ASIC 37 generates various kinds of detection values on the basis of a detection signal of the PF rotary encoder 34 input to the ASIC 37, a detection signal of the ASF rotary encoder 35, a detection signal of the PE sensor 36, and the like, and updates the data stored in the memory 39. The detection value calculation unit 43 periodically generates various kinds of detection values for every PID control period, for example, and updates the generated detection values in the memory 39.

Specifically, the detection value calculation unit 43 measures, as a PF section pulse number, the number of pulses per unit time in the detection signal of the PF rotary encoder 34. The detection value calculation unit 43 records the PF section pulse number, as the PF detection speed 51 indicating the transport speed determined by the PF roller 14, in the memory 39.

The detection value calculation unit 43 measures, as a PF accumulated pulse number, the number of accumulated pulses in the detection signals of the PF rotary encoder 34. The detection value calculation unit 43 records the PF accumulated pulse number, as the PF absolute transport amount 52 indicating the accumulated transport amount by the PF roller 14, in the memory 39.

The detection value calculation unit 43 measures, as an ASF section pulse number, the number of pulses per unit time in the detection signal of the ASF rotary encoder 35. The detection value calculation unit 43 records the ASF section pulse number, as the ASF detection speed 54 indicating the transport speed determined by the LD roller 11, in the memory 39.

The detection value calculation unit 43 measures, as an ASF accumulated pulse number, the number of accumulated pulses in the detection signals of the ASF rotary encoder 35. The detection value calculation unit 43 records the ASF accumulated pulse number, as the ASF absolute transport amount 55 indicating the accumulated transport amount by the LD roller 11, in the memory 39.

The detection value calculation unit 43 determines whether to perform detection of the print media P using the PE sensor 36 depending on a level of a detection signal of the PE sensor 36. Then, when the print medium P is detected, the detection value calculation unit 43 counts the number of pulses per unit time in the detection signal of the PF rotary encoder 34 after the detection. The detection value calculation unit 43 records the counted pulse number, as the PF transport amount after PE detection 53, in the memory 39. In addition, when the print medium P is detected, the detection value calculation unit 43 counts the number of pulses per unit time in the detection signal of the ASF rotary encoder 35 after the detection. The detection value calculation unit 43 records the counted pulse number, as the ASF transport amount after PE detection 56, in the memory 39.

The PF control execution unit 41 controls driving of the PF motor 31. The PF control execution unit 41 generates an instantaneous current value for controlling a driving speed, a rotation direction, and the like of the PF motor 31 such that the PF detection speed 51 stored in the memory 39 meets a predetermined speed profile. In addition, the PF control execution unit 41 generates an instantaneous current value such that the print medium P stops with the transport amount based on an instruction, for example.

The ASF control execution unit 42 controls driving of the ASF motor 32. The ASF control execution unit 42 generates an instantaneous current value for controlling a driving speed, a rotation direction, and the like of the ASF motor 32 such that the ASF detection speed 54 stored in the memory 39 meets a predetermined speed profile. In addition, the ASF control execution unit 42 generates an instantaneous current value such that the print medium P stops with the transport amount based on an instruction, for example.

The paper feed processing instruction unit 62 included in the microcomputer 38 generates an instruction of paper feed processing for transporting unprinted print media P from the rear feed tray 2 to the printing start position, for example. Specifically, the paper feed processing instruction unit 62 instructs the PF control execution unit 41 to make a paper feed control and instructs the ASF control execution unit 42 to make a paper feed control. In addition, the paper feed processing instruction unit 62 supplies to the ASIC 37 an instruction for driving the ASF sub-motor 33.

The paper transporting processing instruction unit 63 generates an instruction of paper feed processing for transporting the print medium P fed in a printing region between the recording head 22 and the platen 6 by a predetermined amount. Specifically, the paper transporting processing instruction unit 63 instructs the PF control execution unit 41 and supplies the same with the PF target transport amount and the like. Moreover, in a continuous print mode in which the plurality of print media P are continuously transported and printed, the paper transporting processing instruction unit 63 also instructs the ASF control execution unit 42 and supplies the same with the ASF target transport amount and the like.

The paper discharge processing instruction unit 64 generates an instruction of paper discharge processing for transporting the print medium P fed in the printing region from the printing region to a discharge tray, for example. Specifically, the paper transporting processing instruction unit 63 instructs the PF control execution unit 41 and supplies the same with the PF target transport amount and the like. In addition, in a continuous print mode, the paper discharge processing instruction unit 64 also instructs the ASF control execution unit 42 and supplies the same with the ASF target transport amount and the like.

The printing processing instruction unit 65 generates an instruction for one print scanning with respect to the print medium P fed in the printing region. Specifically, the printing processing instruction unit 65 instructs the ASIC 37 to drive a CR motor (not shown) and to apply a voltage having a waveform corresponding to print data to a plurality of piezoelectric elements in a state in which the recording head 22 faces the print medium P.

The next control determination unit 61 determines a state while the ink jet printer 1 stops. In addition, the next control determination unit 61 selects one of the plurality of processing instruction units, such as the paper feed processing instruction unit 62, the paper transporting processing instruction unit 63, the paper discharge processing instruction unit 64, and the printing processing instruction unit 65 in accordance with a result of the determination, and instructs the selected processing instruction unit to make an execution.

For example, in the case when print data is supplied from a personal computer (not shown) to the ink jet printer 1, if it is determined to be a printable state, the next control determination unit 61 sequentially selects one of the paper feed processing instruction unit 62, the paper transporting processing instruction unit 63, the paper discharge processing instruction unit 64, and the printing processing instruction unit 65 and instructs the selected processing instruction unit to make the execution whenever the selection is made in order to cause printing based on the print data to be executed. In the case when the printing is normally executed, first, the next control determination unit 61 selects the paper feed processing instruction unit 62. Then, the next control determination unit 61 alternately selects the printing processing instruction unit 65 and the paper transporting processing instruction unit 63 until there is no print data that is not printed. Then, if there is no print data that is not printed, the next control determination unit 61 selects the paper discharge processing instruction unit 64. Then, the print medium P is fed to a printing region where the print medium P faces the recording head 22, and printing based on the print data is executed by repetition of print scanning and a predetermined amount of paper feeding. Then, the print medium P is discharged to the discharge tray.

Next, an operation of the ink jet printer 1, which has the configuration described above, according to the embodiment will be explained. Here, an operation in a continuous print mode will be specifically described.

Figure 3:
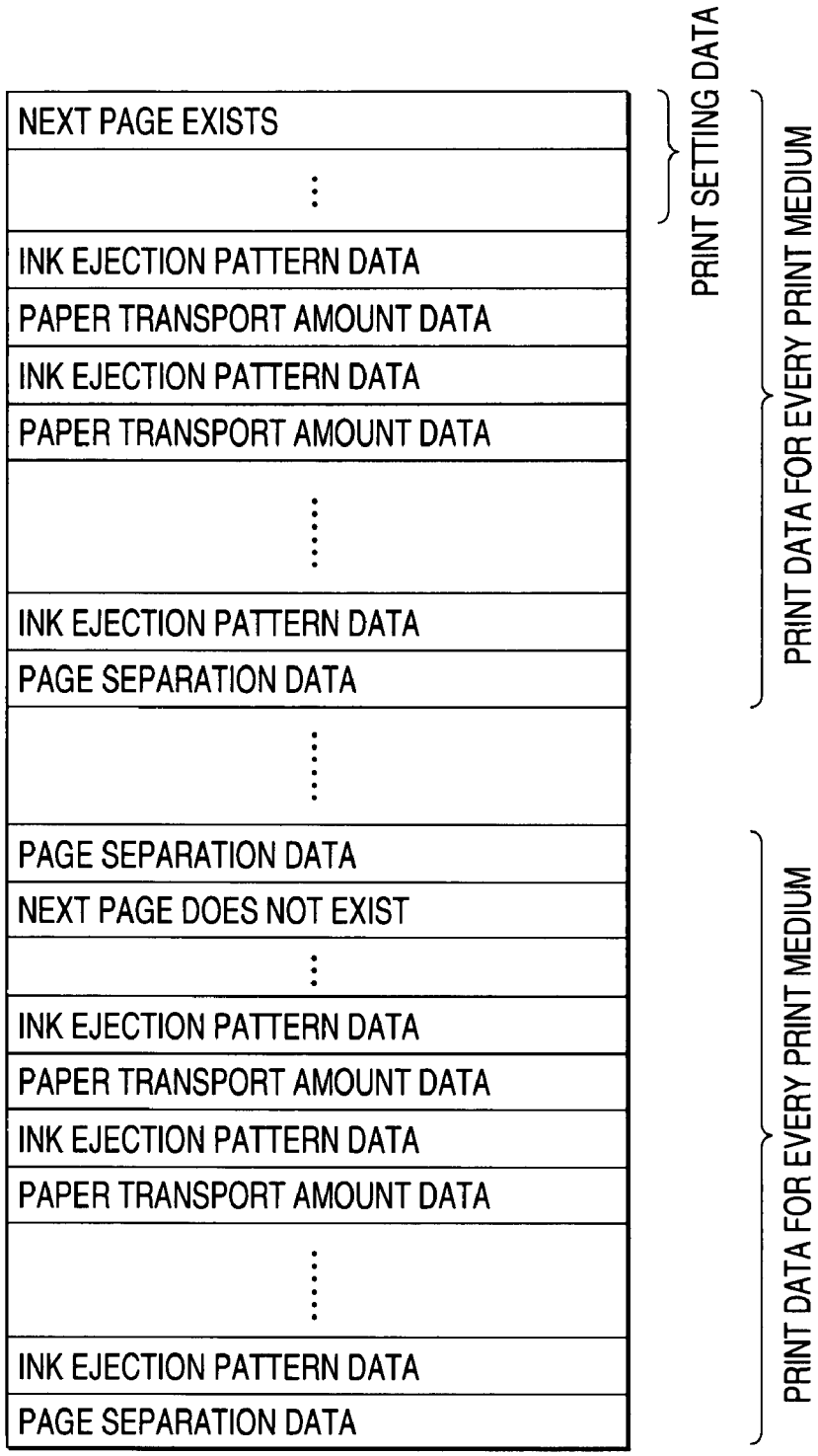
FIG. 3 is an explanatory view illustrating the data structure of print data for continuous printing in the embodiment.

FIG. 3 is an explanatory view illustrating the data structure of print data for continuous printing supplied to the ink jet printer 1 shown in FIG. 1.

The print data for continuous printing supplied to the ink jet printer 1 has print data corresponding to each of a plurality of print media used when controlling printing onto each print medium P. The print data corresponding to each print medium has print setting data that specifies the size of paper to be printed and the like, a plurality of ink ejection pattern data obtained by dividing an image to be printed on the print medium P for one printing width, for example, a plurality of paper transport amount data inserted between two continuous ink ejection pattern data, and page separation data. The plurality of ink ejection pattern data and the plurality of paper transport amount data are alternately arrayed in the print data for each print medium.

In addition, assuming that the number of sheets of paper is 'n' ('n' is an integer equal to or larger than 2), print data corresponding to first to 'n−1' print media includes a next page existence data, which indicates that a next print page exists, in leading print setting data thereof. Print data corresponding to the final 'n' print medium includes a next page no-existence data, which indicates that a next print page does not exist, in leading print setting data thereof.

When print data for continuous printing having such data structure is supplied, the ink jet printer 1 executes printing based on the continuous print mode. The inkjet printer 1 performs printing while continuously transporting the plurality of print media P placed in the rear feed tray 2. Further, in the same manner as in the common print mode, the next control determination unit 61 of the ink jet printer 1 first selects the paper feed processing instruction unit 62 for each print medium. Then, the next control determination unit 61 alternately selects the printing processing instruction unit 65 and the paper transporting processing instruction unit 63 until there is no print data that is not printed. Then, if there is no print data that is not printed, the next control determination unit 61 selects the paper discharge processing instruction unit 64. The next control determination unit 61 transports the print media P corresponding to the number of sheets designated by the print data for continuous printing and executes printing.

Hereinafter, a detailed printing operation of the ink jet printer 1 in the continuous print mode will be described.

Figure 4:
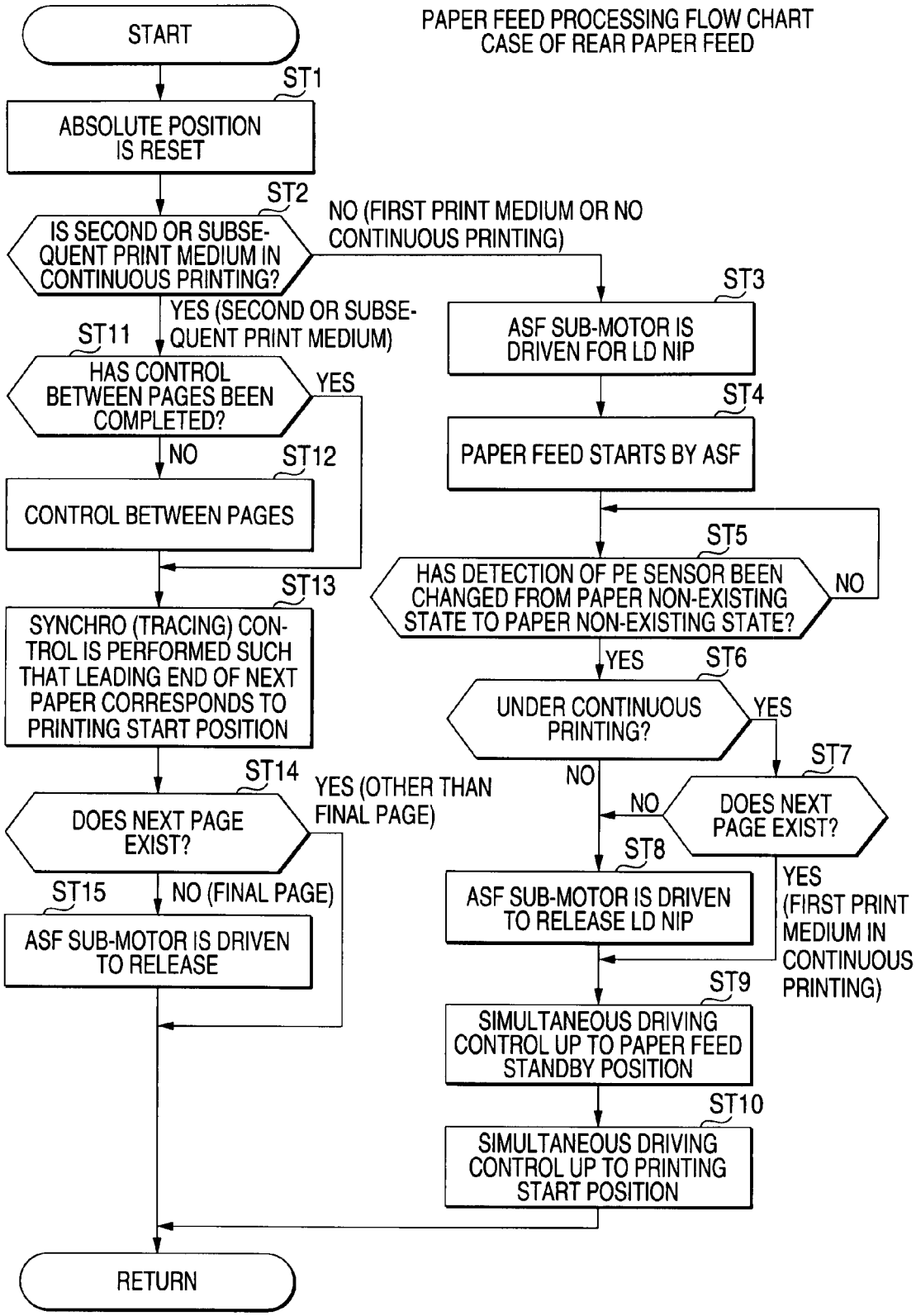
FIG. 4 is a flow chart illustrating processing in a continuous print mode of a paper feed processing instruction unit shown in FIG. 2.
Figure 5:
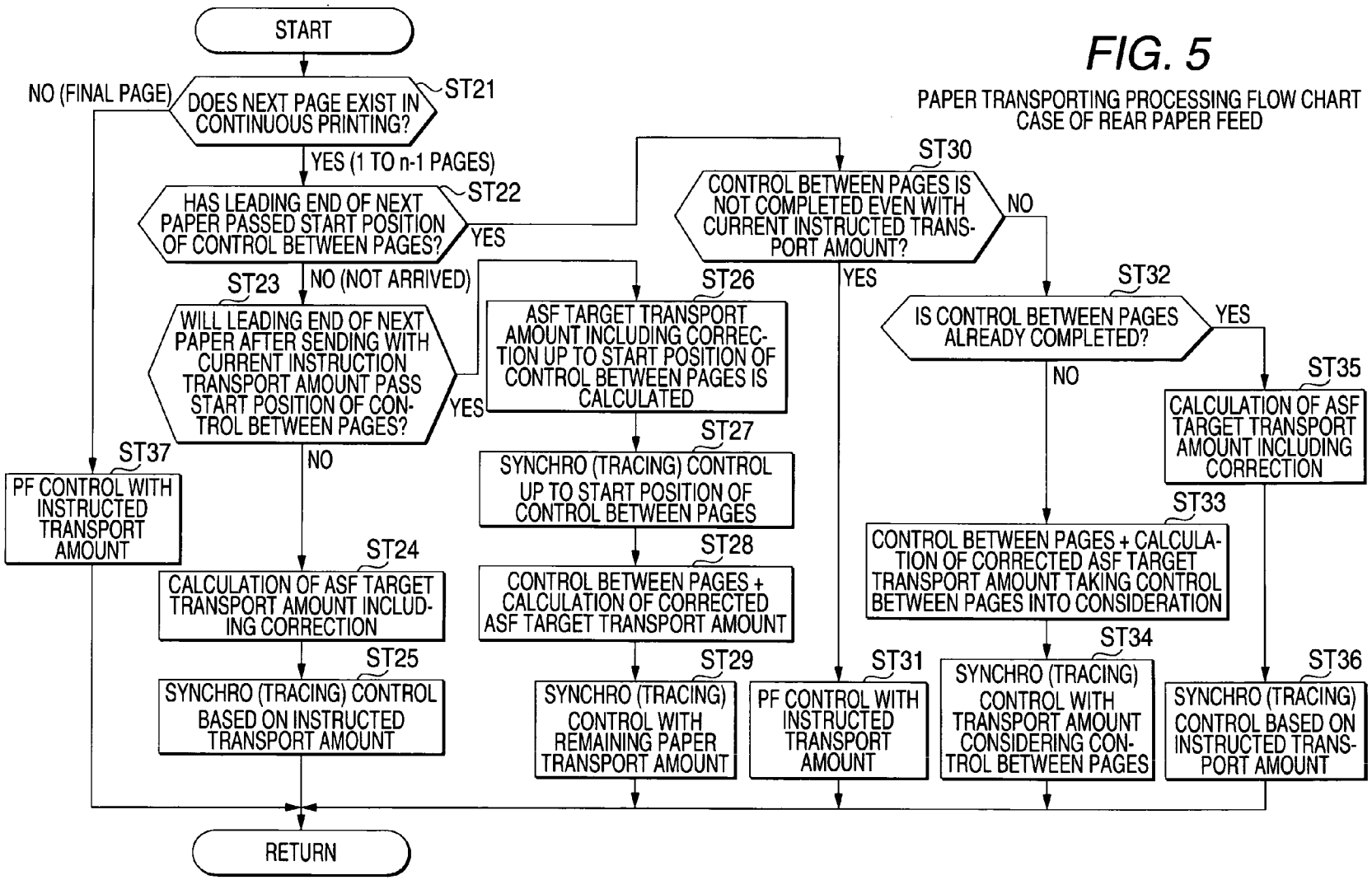
FIG. 5 is a flow chart illustrating processing in a continuous print mode of a paper transporting processing instruction unit shown in FIG. 2.
Figure 6:
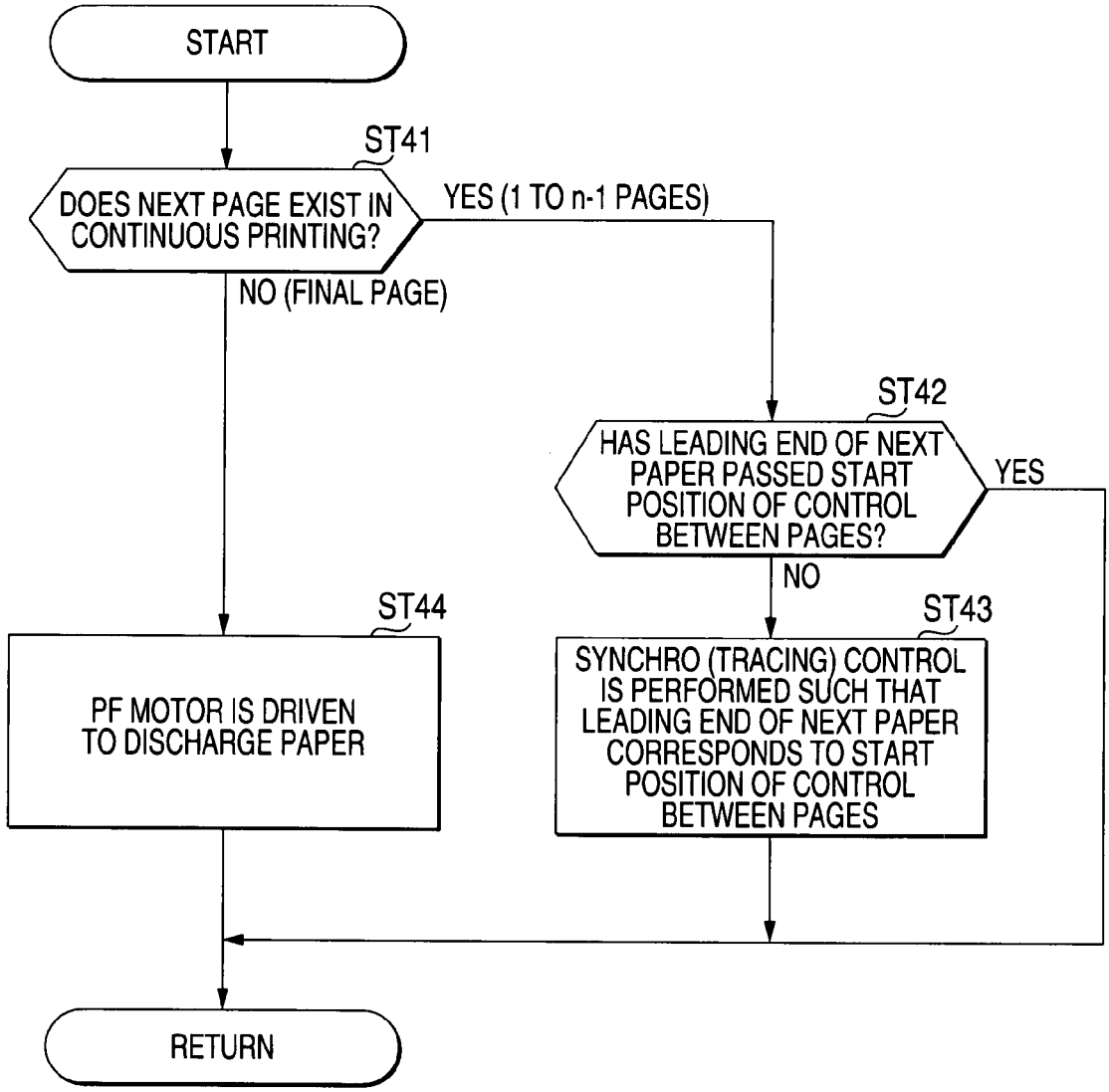
FIG. 6 is a flow chart illustrating processing in a continuous print mode of a paper discharge processing instruction unit shown in FIG. 2.

FIG. 4 is a flow chart illustrating the flow of processing that is executed in the continuous print mode by the paper feed processing instruction unit 62 shown in FIG. 2. FIG. 5 is a flow chart illustrating the flow of processing that is executed in the continuous print mode by the paper transporting processing instruction unit 63 shown in FIG. 2. FIG. 6 is a flow chart illustrating the flow of processing that is executed in the continuous print mode by the paper discharge processing instruction unit 64 shown in FIG. 2.

When the print data for continuous printing shown in FIG. 3 is supplied to the ink jet printer 1, the next control determination unit 61 starts data processing. The next control determination unit 61 checks that the ink jet printer 1 is in a printable state and then reads head data of the print data for continuous printing. The next control determination unit 61 reads print setting data of the print data of the first print medium and instructs the paper feed processing instruction unit 62 to make an execution.

In addition, there is a physical capacity limitation in a receiving buffer of the print data (not shown) of the ink jet printer 1. For this reason, in actuality, the print data for continuous printing is separately supplied to the ink jet printer 1 a plurality of times in accordance with an empty situation of the receiving buffer. Even in the situation, the next control determination unit 61 can read the head data of the print data for continuous printing. The physical capacity limitation does not cause a problem related to a control.

When the execution is instructed, the paper feed processing instruction unit 62 executes a paper feed processing flow chart shown in FIG. 4. First, the paper feed processing instruction unit 62 resets the PF absolute transport amount 52 and the ASF absolute transport amount 55, which are stored in the memory 39 of the ASIC 37, to '0' (step ST1). Thus, the PF absolute transport amount 52 and the ASF absolute transport amount 55 indicate the transport amount from paper feeding for each print medium P.

After resetting the absolute position, the paper feed processing instruction unit 62 determines whether or not current paper feed processing corresponds to processing for the second and subsequent print media P in the continuous printing (step ST2). The current paper feed processing is first paper feeding in the continuous printing. The paper feed processing instruction unit 62 determines 'No' in step ST2.

If the paper feed processing instruction unit 62 determines that the paper feed processing is not processing for the second and subsequent print media P in the continuous printing, the paper feed processing instruction unit 62 instructs the ASIC 37 to drive the ASF sub-motor 33 (step ST3). The ASIC 37 drives the ASF sub-motor 33. As a result, the LD follower roller 12 is pressed against the LD roller 11. The print medium P on the rear feed tray 2 is inserted between the hopper 13 and the LD roller 11.

After driving the ASF sub-motor 33 so that the LD follower roller 12 is pressed against the LD roller 11, the paper feed processing instruction unit 62 instructs the ASF control execution unit 42 to start the paper feeding (step ST4). Specifically, the paper feed processing instruction unit 62 instructs the ASF control execution unit 42 to control the paper feeding. The ASF control execution unit 42 starts driving of the ASF motor 32. By the driving of the ASF motor 32, the LD roller 11 starts to rotate. The uppermost print medium P being in contact with the LD roller 11 starts to be transported along the rotation of the LD roller 11.

In addition, the LD follower roller 12 is pressed against the LD roller 11. Accordingly, even if the print medium P other than the uppermost print medium P, for example, the second print medium P from the above starts to be transported together with the uppermost print medium P as the LD roller 11 rotates, it is difficult that the print medium P other than the uppermost print medium P passes a position where the ink jet printer 1 and the LD follower roller 12 are pressed against each other. The LD follower roller 12 serves as a load that prevents the second print medium P and the like from being fed.

Furthermore, as the ASF motor 32 is driven, the ASF rotary encoder 35 starts to output a detection signal having a pulse waveform. The detection value calculation unit 43 updates the ASF detection speed 54 and the ASF absolute transport amount 55 in the memory 39 on the basis of the detection signal.

The ASF control execution unit 42 that has started driving of the ASF motor 32 reads the ASF detection speed 54 stored in the memory 39, for example, in a predetermined period such as a PID control period. The ASF control execution unit 42 generates an instantaneous current value having a PID control value corresponding to deviation of the ASF detection speed 54 with respect to the ASF target speed. The rotation speed of the ASF motor 32 increases or decreases in accordance with the instantaneous current value. The ASF control execution unit 42 executes the PID control such that the ASF detection speed 54 meets a predetermined speed profile. The print medium P is transported at a predetermined speed.

The print medium P that has started to be transported by the rotation of the LD roller 11 moves toward the discharge tray above the rear transport path 4. The print medium P passes the PE sensor 36 and then knocks between the PF roller 14 and the PF follower roller 15.

When a leading end of the print medium P enters between the light-emitting element and the light-receiving element of the PE sensor 36, a detection signal of the PE sensor 36 changes from a paper non-existing state to a paper existing state. When there is paper detection made by the PE sensor 36, the detection value calculation unit 43 starts to update the PF transport amount after PE detection 53 and the ASF transport amount after PE detection 56 stored in the memory 39.

The detection value calculation unit 43 updates the PF transport amount after PE detection 53 in accordance with the transport amount of the LD roller 11, which is calculated on the basis of a detection signal of the PF rotary encoder 34, after the detection of the print medium P made by the PE sensor 36. The detection value calculation unit 43 updates the ASF transport amount after PE detection 56 in accordance with the transport amount of the LD roller 11, which is calculated on the basis of a detection signal of the ASF rotary encoder 35, after the detection of the print medium P made by the PE sensor 36.

In addition, the detection value calculation unit 43 may always update the PF transport amount after PE detection 53, the ASF transport amount after PE detection 56, or the like on the basis of the detection signal of the ASF rotary encoder 35 or the PF rotary encoder 34.

After starting rotary driving of the LD roller 11 in step ST4, the paper feed processing instruction unit 62 recognizes that the PE sensor 36 has detected the print medium P on the basis of the PF transport amount after PE detection 53 or the ASF transport amount after PE detection 56, for example (step ST5). The paper feed processing instruction unit 62 determines whether or not the current paper feed processing corresponds to continuous printing (step ST6). It is determined that the paper feed processing corresponds to continuous printing, the paper feed processing instruction unit 62 determines whether or not printing corresponding to a next page exists (step ST7). The current paper feed processing is first paper feed processing of continuous printing, and there is printing corresponding to a next page. The paper feed processing instruction unit 62 determines 'Yes' in step ST7 and starts a simultaneous driving control up to the paper feed standby position (step ST9). The LD follower roller 12 is held in a state in which the LD follower roller 12 is pressed against the LD roller 11.

Moreover, when the current paper feed processing is not continuous printing (in the case of 'No' in step ST6) or when there is no following page (in the case of 'No' in step ST7), the paper feed processing instruction unit 62 instructs the ASIC 37 to perform nip release (step ST8). The ASIC 37 drives the ASF sub-motor 33, such that the LD follower roller 12 is spaced apart from the LD roller 11.

Then, the paper feed processing instruction unit 62 executes a simultaneous driving control up to the paper feed standby position (step ST9). The paper feed processing instruction unit 62 instructs the PF control execution unit 41 to drive the PF motor 31. The PE control execution unit 41 starts driving of the PF motor 31. The PF roller 14 and the PF follower roller 15 start to rotate. The print medium P that has knocked between the PF roller 14 and the PF follower roller 15 is nipped between the PF roller 14 and the PF follower roller 15 and then starts to be fed to a printing region by the rotation of the PF roller 14 and the PF follower roller 15.

Furthermore, as the PF motor 31 is driven, the PF rotary encoder 34 starts to output a detection signal having a pulse waveform in accordance with the rotation of the PF roller 14. The detection value calculation unit 43 updates the PF detection speed 51, the PF absolute transport amount 52, and the PF transport amount after PE detection 53 in the memory 39 on the basis of the detection signal. The PF control execution unit 41 that has started driving of the PF motor 31 reads the PF detection speed 51 stored in the memory 39, for example, in a predetermined period such as a PID control period. The PF control execution unit 41 generates an instantaneous current value having a PID control value corresponding to deviation of the PF detection speed 51 with respect to the PF target speed. The rotation speed of the PF motor 31 increases or decreases in accordance with the instantaneous current value. The PF control execution unit 41 executes the PID control such that the PF detection speed 51 meets a predetermined speed profile. The print medium P is transported at a predetermined speed.

When the paper feed control is instructed, the PF control execution unit 41 periodically reads the PF transport amount after PE detection 53 stored in the memory 39 of the ASIC 37. The PF control execution unit 41 starts a deceleration control in a predetermined pulse number such that the PF motor 31 stops when the read PF transport amount after PE detection 53 becomes a transport amount equivalent to a distance from the PE sensor 36 to the paper feed standby position. The PF control execution unit 41 reduces a current command value with respect to the PF motor 31 such that the PF motor 31 stops.

Similarly, the ASF control execution unit 42 periodically reads the ASF absolute transport amount 55 stored in the memory 39 of the ASIC 37. The ASF control execution unit 42 starts a deceleration control in a predetermined pulse number such that the ASF motor 32 stops when the read ASF transport amount after PE detection 56 becomes a transport amount equivalent to a distance from the PE sensor 36 to the paper feed stand by position. The ASF control execution unit 42 reduces a current command value with respect to the ASF motor 32 such that the ASF motor 32 stops.

Through the processing described above, the print medium P placed at the top of the rear feed tray 2 is fed such that a leading end edge of the print medium P stops at the paper feed standby position. The first print medium P is fed up to the paper feed standby position by the simultaneous driving control of the PF motor 31 and the ASF motor 32.

After feeding the first print medium P up to the paper feed standby position, the paper feed processing instruction unit 62 instructs the PF control execution unit 41 and the ASF control execution unit 42 to make a control of feeding paper up to the printing start position. The PF control execution unit 41 and the ASF control execution unit 42 transports the print medium P again up to the print medium P by the simultaneous driving control of the PF motor 31 and the ASF motor 32 (step ST10).

If the paper feed processing by the above simultaneous driving control is completed, the paper feed processing instruction unit 62 ends the first paper feed processing. The PF roller 14 and the LD roller 11 stop. The PF detection speed 51 and the ASF detection speed 54 stored in the memory 39 of the ASIC 37 are also updated to '0'. The next control determination unit 61 determines whether or not the ink jet printer 1 has normally stopped on the basis of the speed data of the memory 39 and the like and reads the first continuous data of the print data for continuous printing. The next control determination unit 61 reads first ink ejection pattern data of the first print data for every print medium and instructs the printing processing instruction unit 65 to make an execution.

When the execution is instructed, the printing processing instruction unit 65 executes the printing processing. The printing processing instruction unit 65 supplies the ink ejection pattern data to the ASIC 37 and instructs the ASIC 37 to drive the CR motor (not shown). The carriage 21 moves by driving of the CR motor using the ASIC 37. The ASIC 37 applies a voltage having a waveform based on the ink ejection pattern data to the plurality of piezoelectric elements in a state in which the plurality of ink ejecting nozzles 23 of the recording head 22 face the print medium P. Ink is discharged from the plurality of ink ejecting nozzles 23 to be adhered onto the print medium P.

If the first print control processing described above is completed, the printing processing instruction unit 65 ends the first one print scanning. The next control determination unit 61 determines whether or not the ink jet printer 1 has normally stopped on the basis of the detection speed of the carriage 21 and the like and reads the first continuous data of the print data for continuous printing. The next control determination unit 61 reads first paper transport amount data of the first print data for every print medium and instructs the paper transporting processing instruction unit 63 to make an execution.

When the execution is instructed, the paper transporting processing instruction unit 63 executes the paper transporting processing flow chart shown in FIG. 5. First, the paper transporting processing instruction unit 63 determines whether or not current paper transporting processing is in a continuous printing mode and whether or not the following page exists on the basis of the print data for continuous printing and the like (step ST21). The current paper transporting processing is the first print medium P of the continuous printing. The paper transporting processing instruction unit 6, determines 'YES' in step ST21.

Subsequently, the paper transporting processing instruction unit 63 determines whether or not a leading end edge of the next print medium P passes the start position of control between pages (step ST22). The current paper transporting processing is the first paper feed processing of the print medium P, and the print medium P under printing exists at the start position of control between pages. The paper transporting processing instruction unit 63 determines 'No (not arrived)' in step ST22.

In addition, the paper transporting processing instruction unit 63 determines whether or not a leading end edge of the next print medium P will pass the start position of control between pages as a result of the execution of the current paper transporting processing (step ST23). The current paper transporting processing is the first paper feed processing of the print medium P, and feeding of the next print medium P does not start. The paper transporting processing instruction unit 63 determines 'No' in step ST23.

The paper transporting processing instruction unit 63 that has determined 'No' in step ST23 sets as a new PF target transport amount (the number of pulses), a difference between a value obtained by adding a paper transport amount newly instructed this time to an accumulated value of the PF target transport amount instructed to the PF control execution unit 41 after completion of paper feed and the PF absolute transport amount 52 (an actual transport amount based on the instruction up to last time) after completion of paper feed, and calculates a new ASF target transport amount (the number of pulses) including the amount of correction (step ST24). Specifically, the paper transporting processing instruction unit 63 calculates the new ASF target transport amount including the amount of correction on the basis of the following Expression 1. The new ASF target transport amount including the amount of correction becomes slightly greater than the new PF target transport amount.

In the following Expression 1, '1.05' is a target transport amount correction ratio coefficient that means feeding in a margin of about 5%. Preferably, the target transport amount correction ratio coefficient is larger than 1 and equal to or smaller than 1.05, for example. If the target transport amount correction ratio coefficient is equal to or smaller than 1, there is no effects of correction. In addition, if the target transport amount correction ratio coefficient is larger than 1.05, the deflection of the print medium P loaded by the LD roller 11 increases, such that the transport amount of the print medium does not suitably follow the transport amount of the PF roller 14.

ASF target transport amount(number of pulses)=PF target transport amount(number of pulses)×1.05 Expression 1

Further, in the case when resolution of the transport amount of the PF rotary encoder 34 is different from resolution of the transport amount of the ASF rotary encoder 35, it is preferable to multiply the ASF target transport amount obtained from Expression 1 by a correction coefficient of resolution based on a ratio of the detection pulse number of the ASF rotary encoder 35 to the detection pulse number of the PF rotary encoder 34 in the predetermined transport amount and to set a result of the calculation as the new ASF target transport amount (the number of pulses) instructed to the ASF control execution unit 42.

After calculating the PF target transport amount (the number of pulses) and the ASF target transport amount (the number of pulses), the paper transporting processing instruction unit 63 executes a synchro (tracing) control using the instructed paper transport amount as a reference (step ST25).

FIG. 7 is a view illustrating a comparison table of features of the synchro (tracing) control and features of the simultaneous driving control in the ink jet printer 1 shown in FIG. 1. The left side of FIG. 7 is a list of main features of the synchro (tracing) control, and the right side of FIG. 7 is a list of main features of the simultaneous driving control. The features listed will now be described below.

First, in the case of the synchro (tracing) control, as shown in a column A of FIG. 7, there is a feature related to the driving timing of the PF motor 31 and the ASF motor 32. Specifically, in the case of the synchro (tracing) control, the PF motor 31 and the ASF motor 32 are driven simultaneously in the same manner as in the case of the simultaneous driving control. In particular, in the synchro (tracing) control, the driving of the ASF motor 32 starts prior to the driving of the PF motor 31. In the case of the simultaneous driving control, there is no restriction on the start of such driving. Basically, the PF motor 31 and the ASF motor 32 are driven simultaneously.

Second, as shown in a column B of FIG. 7, the synchro (tracing) control is characterized in that the amount of correction is calculated such that the transport amount of the ASF motor 32 is slightly greater than the transport amount of the PF motor 31. Specifically, in the case of the synchro (tracing) control, the ASF target transport amount (the number of pulses) is set to be slightly greater than the PF target transport amount (the number of pulses) by the calculation based on Expression 1. Such transport amount correction is not made in the simultaneous driving control. The PF target transport amount (the number of pulses) and the ASF target transport amount (the number of pulses) are calculated separately.

Third, as shown in a column C of FIG. 7, the synchro (tracing) control is characterized in that the ASF target transport amount for driving the ASF motor 32 follows the PF target transport amount for driving the PF motor 31. Specifically, in the case of the synchro (tracing) control, the ASF target transport amount instructed to the ASF control execution unit 42 is based on the PF target transport amount instructed to the PF control execution unit 41, as shown in the calculation of Expression 1 described above. The PF target transport amount instructed to the PF control execution unit 41 is a difference between a value, which is obtained by adding a paper transport amount newly instructed this time to an accumulated value of the PF target transport amount instructed to the PF control execution unit 41 after completion of paper feed, and the PF absolute transport amount 52 (the actual transport amount based on the instruction up to last time) after completion of paper feed. In contrast, in the case of the simultaneous driving control, the ASF target transport amount instructed to the ASF control execution unit 42 is a difference between a value, which is obtained by adding a paper transport amount newly instructed this time to an accumulated value of the PF target transport amount instructed to the ASF control execution unit 42 after completion of paper feed, and the ASF absolute transport amount 55 (the actual transport amount based on the instruction up to last time) after completion of paper feed. That is, the ASF absolute transport amount 55 serves as a reference.

Fourth, as shown in a column D of FIG. 7, the synchro (tracing) control is characterized in that a reference rotary encoder is changed when controlling the paper feed position. Specifically, in the case of synchro (tracing) control, the paper feed position of the second and subsequent print media P in continuous printing is determined such that the ASF transport amount after PE detection 56 after the PE sensor 36 detects the print medium becomes a transport amount corresponding to a distance from the PE sensor 36 to the printing start position. In the simultaneous driving control, the paper feed position is determined all the time such that the PF transport amount after PE detection 53 after the PE sensor 36 detects the print medium becomes a transport amount corresponding to a distance from the PE sensor 36 to the printing start position.

The synchro (tracing) control has the features of control described above as compared with the simultaneous driving control.

Moreover, in the synchro (tracing) control (step ST24) using the instructed feed amount as a reference, the paper transporting processing instruction unit 63 instructs the PF control execution unit 41 and the ASF control execution unit 42, and provide them with the PF target transport amount and the ASF target transport amount, respectively.

In the synchro (tracing) control, first, the ASF control execution unit 42 starts driving of the ASF motor 32. Then, the print medium P nipped between the LD roller 11 and the LD follower roller 12 is transported. At this time, the print media P sags between the LD roller 11 and the PF roller 14.

If a value of the ASF absolute transport amount 55 changes by a predetermined amount, the PF control execution unit 41 starts driving of the PF motor 31. Then, the print medium P nipped between the PF roller 14 and the PF follower roller 15 starts to be transported. The print medium P is fed and transported while maintaining a state in which the print medium P sags between the LD roller 11 and the PF roller 14.

The ASF control execution unit 42 stops the ASF motor 32 that is being driven such that the change amount of the ASF absolute transport amount 55 after the start of paper transport control becomes the instructed ASF target transport amount. The PF control execution unit 41 that has started the driving, which is delayed, stops the PF motor 31 that is being driven such that the change amount of the PF absolute transport amount 52 after the start of paper transport control becomes the instructed PF target transport amount. The transport amount of the print medium P, which has been transported to a downstream side of the transport direction of the print medium P by the PF roller 14, is a transport amount (the number of pulses) for the PF roller 14 and serves as the instructed target transport amount.

In addition, driving of the ASF motor 32 starts earlier than that of the PF motor 31. However, the ASF target transport amount of the LD roller 11 is approximately equal to the PF target transport amount of the PF roller 14. Accordingly, in the state in which the ASF motor 32 and the PF motor 31 stop, the sagging between the LD roller 11 and the PF roller 14 almost disappears.

In addition, the ASF target transport amount of the LD roller 11 is slightly greater than the PF target transport amount of the PF roller 14. Therefore, transport of the print medium P using the PF motor 31 is not hindered by the LD roller 11 that is in a stopping state. By rotation of the PF roller 14 after the ASF motor 32 has stopped, the print medium P is not stretched very tight between the LD roller 11 and the PF roller 14. As a result, the actual transport amount of the print medium P at the downstream side from the PF roller 14 suitably follows the PF target transport amount of the PF roller 14, such that the actual transport amount of the print medium P matches the instructed paper transport amount with high precision.

Through the processing described above, the first one paper transporting processing performed by the paper transporting processing instruction unit 63 is completed.

As shown in FIG. 3, ink ejection pattern data and paper transport amount data are alternately arranged in a line in the print data for every print medium. The printing processing instruction unit 65 and the paper transporting processing instruction unit 63 are alternately executed in accordance with the order in which the ink ejection pattern data and the paper transport amount data are arranged in a line. Accordingly, printing based on the print data is performed on the print medium P for every scan width, for example.

As described above, when printing processing on the first print medium P progresses and a trailing end edge of the first print medium P passes between the LD roller 11 and the LD follower roller 12, the second print medium P, which is pressed by the hopper 13 and is placed at the top of the rear feed tray 2, is fed as the LD roller 11 rotates and is nipped between the LD roller 11 and the LD follower roller 12. The second print medium P starts to be continuously fed subsequent to the first print medium P by the rotation of the LD roller 11 under the synchro (tracing) control and the PF motor 31 under the paper transport control. In general, the second print medium P starts to be fed without a spacing between the first print medium P and the second print medium P.

Thereafter, in the paper transporting processing for printing onto the first print medium P, the paper transporting processing instruction unit 63 changes the instruction of paper feed processing in accordance with a state in which the second print medium P is transported. Specifically, the paper transporting processing instruction unit 63 changes the instruction of paper transporting processing in accordance with the following pattern. Paper transporting processing corresponding to each pattern will be described with reference to FIGS. 2 and 5.

First, in the case that a leading end edge of the second print medium P has not passed the start position of control between pages immediately after the second print medium P started to be transported (in the case when the leading end edge of the second print medium P is in a region A), the paper transporting processing instruction unit 63 determines 'No' in step ST23 if it is expected that there is nothing that will pass the start position of control between pages even when the current paper transporting processing is completed (in the case of the region A shown in FIG. 2). The paper transporting processing instruction unit 63 sets as a new PF target transport amount (the number of pulses) a difference between a value, which is obtained by adding a paper transport amount newly instructed this time to an accumulated value of the PF target transport amount instructed to the PF control execution unit 41 after completion of paper feed, and the PF absolute transport amount 52 (the actual transport amount based on the instruction up to last time) after completion of paper feed, calculates the ASF target transport amount of the LD roller 11 slightly greater than the new PF target transport amount on the basis of Expression 1 (step ST24), and executes the synchro (tracing) control (step ST25).

Second, if it is expected that a leading end edge of the next print medium will pass the start position of control between pages at the time of completion of the current paper transporting processing (in the case when the region A shown in FIG. 2 moves to a region B), the paper transporting processing instruction unit 63 determines 'Yes' in step ST23. First, the paper transporting processing instruction unit 63 sets as a new PF target transport amount (the number of pulses) a difference between a value, which is obtained by adding an amount of transport up to the start position of control between pages to the accumulated value of the PF target transport amount instructed to the PF control execution unit 41 after completion of paper feed, and the PF absolute transport amount 52 (the actual transport amount based on the instruction up to last time) after completion of paper feed, calculates the ASF target transport amount of the LD roller 11 slightly greater than the new PF target transport amount on the basis of Expression 1 (step ST26), and executes the synchro (tracing) control (Step ST27).

Then, the paper transporting processing instruction unit 63 sets, as a new PF target transport amount (the number of pulses) for the PF roller 14, a difference between a value, which is obtained by adding a remaining part of the paper transport amount newly instructed this time to the accumulated value of the PF target transport amount (including the previous transport amount up to the start position of control between pages) instructed to the PF control execution unit 41 after completion of paper feed, and the PF absolute transport amount 52 (an amount of change based on the control up to the previous start position of control between pages), calculates the ASF target transport amount of the LD roller 11 slightly greater than the new PF target transport amount on the basis of Expression 1 (step ST28), and executes the synchro (tracing) control (step ST29). Thus, the control between pages is completed. Then, the print medium under printing is transported by the paper transport amount newly instructed this time and the next print medium is transported to the position, a gap length between pages being provided between the print medium under printing and the position.

Third, in the case that a leading end edge of the second print medium P is within a range of a distance of the gap length between pages from the start position of control between pages (in the case when the leading end edge of the second print medium P is in the region B), the paper transporting processing instruction unit 63 determines 'Yes' in step ST22 and 'Yes' in step ST30 if it is expected that there is nothing that will not pass the region B even when the current paper transporting processing is completed. The paper transporting processing instruction unit 63 sets as a new PF target transport amount (the number of pulses) a difference between a value, which is obtained by adding the paper transport amount newly instructed this time to the accumulated value of the PF target transport amount instructed to the PF control execution unit 41 after completion of paper feed, and the PF absolute transport amount 52 (the actual transport amount based on the instruction up to last time) after completion of paper feed and supplies the new PF target transport amount to the PF control execution unit 41 (step ST31). Thus, only the PF roller 14 transports the print medium P.

Fourth, in the case that a leading end edge of the second print medium P is within a range of a distance of the gap length between pages from the start position of control between pages (in the case when the leading end edge of the second print medium P is in the region B), the paper transporting processing instruction unit 63 determines 'Yes' in step ST22, 'No' in step ST30, and 'No' in step ST32 if it is expected that the leading end edge of the second print medium P will be separated from the start position of control between pages by the gap length between pages or more at the time of completion of the current paper transporting (in the case when the region B shown in FIG. 2 moves to a region C), that is, if the control between pages is completed with the current instruction transport amount. The paper transporting processing instruction unit 63 sets as a new PF target transport amount (the number of pulses) a difference between a value, which is obtained by adding a paper transport amount newly instructed this time to an accumulated value of the PF target transport amount instructed to the PF control execution unit 41 after completion of paper feed, and the PF absolute transport amount 52 (the actual transport amount based on the instruction up to last time) after completion of paper feed, corrects a transport amount correction ratio coefficient using the PF target transport amount, sets a transport amount, which is obtained by subtracting a shortage with respect to the gap length between pages, as a new ASF target transport amount (the number of pulses) for the LD roller 11 (step ST33), and executes the synchro (tracing) control (step ST34). Thus, the control between pages is completed. Then, the print medium under printing is transported by the paper transport amount newly instructed this time and the next supplied print medium is transported to the position, a gap length between pages being provided between the print medium under printing and the position.

Fifth, in the case that the leading end edge of the second print medium P is already distant from the start position of control between pages more than the gap length between pages (in the case when the leading end edge of the second print medium P is in the region C shown in FIG. 2), the paper transporting processing instruction unit 63 determines 'Yes' in step ST22, 'No' in step ST30, and 'Yes' in step ST32. The paper transporting processing instruction unit 63 sets as a new PF target transport amount (the number of pulses) a difference between a value, which is obtained by adding the paper transport amount newly instructed this time to the accumulated value of the PF target transport amount instructed to the PF control execution unit 41 after completion of paper feed, and the PF absolute transport amount 52 (the actual transport amount based on the instruction up to last time) after completion of paper feed, calculates the ASF target transport amount (the number of pulses) of the LD roller 11 slightly greater than the new PF target transport amount (step ST35), and executes the synchro (tracing) control (step ST36).

In addition, the paper transporting processing instruction unit 63 also has a sixth pattern. The sixth pattern is selected, for example, in processing for transporting the final print medium P in continuous printing. In the sixth pattern, the paper transporting processing instruction unit 63 sets as a new PF target transport amount (the number of pulses) a difference between a value, which is obtained by adding the paper transport amount newly instructed this time to the accumulated value of the PF target transport amount instructed to the PF control execution unit 41 after completion of paper feed, and the PF absolute transport amount 52 (the actual transport amount based on the instruction up to last time) after completion of paper feed and supplies the new PF target transport amount to the PF control execution unit 41 (step ST37). Thus, only the PF roller 14 transports the print medium P.

Furthermore, if the leading end edge of the next print medium P passes the PE sensor 36 through the paper transport control described above, the detection value calculation unit 43 updates the PF transport amount after PE detection 53 and the ASF transport amount after PE detection 56, which are stored in the memory 39, to a new transport amount after paper detection using the PE sensor 36.

As described above, while instruction patterns are changed in the paper transporting processing performed by the paper transporting processing instruction unit 63, the paper feed processing and the printing processing for the first print medium P are repeated. Then, the next control determination unit 61 reads first page separation data that separates the first print medium and the second print medium from each other. The next control determination unit 61 instructs the paper discharge processing instruction unit 64 makes an execution.

When the execution is instructed, the paper discharge processing instruction unit 64 executes a printing processing flow chart shown in FIG. 6. First, the paper discharge processing instruction unit 64 determines whether or not current paper discharge processing is paper discharge processing under continuous printing and whether or not next page printing exists (step ST41). The current paper discharge processing is paper discharge processing for the first print medium P in the continuous printing. The paper discharge processing instruction unit 64 determines 'Yes' in step ST41.

Then, the paper discharge processing instruction unit 64 determines whether or not a leading end edge of the next print medium P has already passed the start position of control between pages (step ST42). Then, for example, if printing corresponding to about a half of the first print medium P is completed, the leading end edge of the next print medium P has not passed the start position of control between pages. In this case, the paper discharge processing instruction unit 64 determines 'No' in step ST42.

If it is determined that the leading end edge of the next print medium P has not passed the start position of control between pages, the paper discharge processing instruction unit 64 sets the PF target transport amount (the number of pulses) for the PF roller 14 as a remaining distance up to the start position of control between pages such that the leading end edge of the next second print medium P corresponds to the start position of control between pages, calculates the ASF target transport amount (the number of pulses) for the LD roller 11, which is slightly greater than the remaining distance, and executes the synchro (tracing) control (step ST43). Thus, the leading end edge of the next print medium P corresponds to the start position of control between pages.

In addition, for example, when printing is to be performed up to a trailing end edge of the first print medium P, a leading end edge of the next print medium P already passes the start position of control between pages. In this case, the paper discharge processing instruction unit 64 determines 'Yes' in step ST42. The paper discharge processing instruction unit 64 ends the paper discharge processing without performing a specific transport control.

As described above, if the paper discharge processing for the print medium P is completed by the paper discharge processing instruction unit 64, the processing for the print data of the first print medium is ended. The leading end edge of the second print medium P is located at the start position of control between pages or between the start position of control between pages and a printing region. The next control determination unit 61 reads print data of the second print medium and instructs the paper feed processing instruction unit 62 to feed the second print medium P.

The paper feed processing instruction unit 62 starts processing for feeding the second print medium P according to the flow chart of FIG. 4. The paper feed processing instruction unit 62 resets the PF absolute transport amount 52 and the ASF absolute transport amount 55, which are stored in the memory 39 of the ASIC 37, to '0' (step ST1) and determines that the current paper feed processing is printing for the second and subsequent print media P in the continuous printing (Yes in step ST2).

Further, the paper feed processing instruction unit having determined that the current paper feed processing is the printing for the second and subsequent print media P in the continuous printing determines whether or not the control between pages is completed (step ST11). In the case when the control between pages is not completed, the paper feed processing instruction unit 62 executes the control between pages (step ST12). Specifically, the paper feed processing instruction unit 62 sets a remaining gap length between pages as the PF target transport amount of the PF roller 14 and instructs only the PF control execution unit 41 of the PF target speed. Thus, only the PF roller 14 transports the print medium P. By the control between pages, a predetermined gap length between pages is secured between the trailing end edge of the first print medium P and the leading end edge of the second print medium P.

Thus, in the case when the gap length between pages is secured or the control between pages has been already completed, the paper feed processing instruction unit 62 instructs the PF control execution unit 41 and the ASF control execution unit 42 to execute a paper feed control by the synchro (tracing) control up to the printing start position (step ST13).

In the synchro (tracing) control up to the printing start position concerning the second and subsequent print media P under the continuous printing, the ASF control execution unit 42 stops driving of the ASF motor 32 such that the ASF transport amount after PE detection 56 becomes a transport amount equivalent to a distance from the PE sensor 36 to the printing start position. In addition, as described as the fourth feature of FIG. 7, the PF control execution unit 41 stops driving of the PF motor 31 such that the PF motor 31 stops when the ASF transport amount after PE detection 56 becomes the transport amount equivalent to the distance from the PE sensor 36 to the printing start position.

Driving of the PF roller 14 starts after the LD roller 11 is driven. In the paper feed control, a transport amount of the PF absolute transport amount 52 or the PF transport amount after PE detection 53 is smaller than a transport amount of the ASF absolute transport amount 55 or the ASF transport amount after PE detection 56 by the delayed amount. That is, the transport amount of the PF absolute transport amount 52 or the PF transport amount after PE detection 53 is smaller than the transport amount of the ASF absolute transport amount 55 or the ASF transport amount after PE detection 56 by a part hatched using oblique lines in 'A' of FIG. 7. As a result, in the case of continuously feeding and transporting the plurality of print media P, the precision of the paper feed position of the second and subsequent print media P deteriorates. The paper feed position of the second and subsequent print media P tends to shift to the upstream side in the transport direction 4 of the print medium P compared with the paper feed position of the first print medium P. The second and subsequent print media P under continuous printing tends to shift to the upstream side of the transport direction 4 from the accurate paper feed position of the first print medium P. As a result, a leading end edge of the print medium P is fed up to only before the printing start position.

In contrast, if the PF control execution unit 41 makes a control of stopping driving of the PF motor 31 such that the PF motor 31 when the ASF transport amount after PE detection 56 becomes the transport amount equivalent to the distance from the PE sensor 36 to the printing start position, the leading end edge of the print medium P is fed to the printing start position with high precision. The paper feed position of the second and subsequent print media P is approximately equal to the paper feed position of the first and subsequent print media P.

Moreover, in actuality, it is preferable that the PF control execution unit 41 starts a deceleration and stop control at the same time as the ASF control execution unit 42 starts a deceleration and stop control. Immediately before the start of the deceleration and stop control, the ASF detection speed 54 by the LD roller 11 and the PF detection speed 51 by the PF roller 14 match each other as approximately constant speed. Accordingly, by matching the start timings of the deceleration and stop controls with each other as described above, the PF control execution unit 41 can stop the PF roller 14 when the ASF control execution unit 42 stops the LD roller 11. The PF control execution unit 41 can make a control such that the PF roller 14 stops when the transport amount of the LD roller 11 after the PE sensor 36 detects the new print medium P continuously fed becomes a predetermined transport amount.

After feeding the second print medium P to the printing start position, the paper feed processing instruction unit 62 determines whether or not the following page printing exists on the basis of print data for continuous printing and the like (step ST14). Then, for example, if there is no following page printing after the second print medium P, the paper feed processing instruction unit 62 supplies to the ASIC 37 an instruction for driving the ASF sub-motor 33 (step ST15). The ASIC 37 drives the ASF sub-motor 33, and the LD follower roller 12 is spaced apart from the LD roller 11. If there is the following page printing after the second print medium P, the paper feed processing instruction unit 62 ends the paper feed processing without causing the LD follower roller 12 to be spaced apart from the LD roller 11.

Through the paper feed processing for the second print medium P described above, the second print medium P is fed up to the printing start position in both a case in which the second print medium P already starts to be fed by the paper transporting processing for the first print medium P and a case in which the second print medium P starts to be fed after the second paper feed processing.

Thereafter, in the ink jet printer 1, the printing control made by the printing processing instruction unit 65 and the paper transport control made by the paper transporting processing instruction unit 63 are repeated on the basis of print data of the second print medium P. In addition, when the next control determination unit 61 reads final page separation data of the print data of the second print medium, paper discharge processing using the paper discharge processing instruction unit 64 starts.

The ink jet printer 1 reads print data for every print medium included in the print data for continuous printing and executes a control, which is the same as for the second print medium P, even for the third and subsequent print media P. Then, when the next control determination unit 61 under continuous printing reads print data of final print medium, a control different from that up to now is executed.

Specifically, in the case of paper transporting processing for the final print medium P, there is no following print page. Accordingly, the paper feed processing instruction unit 62 determines 'No (final page)' in determination of step ST14 in FIG. 4. The paper feed processing instruction unit 62 determines 'No (final page)' on the basis of next page no-existence data included in print setting data, for example. The paper transporting processing instruction unit 63 supplies to the ASIC 37 an instruction for driving the ASF sub-motor 33 (step ST15). The ASIC 37 drives the ASF sub-motor 33, such that the LD follower roller 12 is spaced apart from the LD roller 11.

In addition, since there is no following page to be printed, the paper transporting processing instruction unit 63 determines 'No' in determination of step ST21 in FIG. 5. The paper transporting processing instruction unit 63 sets as a new PF target transport amount (the number of pulses) a difference between a value, which is obtained by adding a paper transport amount newly instructed this time to an accumulated value of a PF target transport amount instructed to the PF control execution unit 41 after completion of paper feed, and the PF absolute transport amount 52 (an actual transport amount based on the instruction up to last time) after completion of paper feed and instructs only the PF control execution unit 41 of the PF target speed (step ST37). Accordingly, the print medium P is transported only by the PF roller 14. A state in which the LD follower roller 12 and the LD roller 11 are pressed against each other is released, such that the print medium P is transported as the PF roller 14 rotates.

In addition, since there is no following page to be printed, the paper discharge processing instruction unit 64 determines 'No (final page)' in determination of step ST41 in FIG. 6. The paper transporting processing instruction unit 63 sets a predetermined transport amount, by which the print medium P being fed can be transported to a discharge tray, as the PF target transport amount (the number of pulses) for the PF roller 14 and instructs only the PF control execution unit 41 of the PF target speed (step ST44). A state in which the LD follower roller 12 and the LD roller 11 are pressed against each other is released, such that the print medium P that has been completely printed is discharged to the discharge tray.

As described above, if print data of a final page among print data for continuous printing is supplied, the ink jet printer 1 executes a different control from the control on the print medium P under the continuous printing until then. That is, the ink jet printer 1 executes a paper transport control approximately equal to printing based on normal print data.

FIG. 8 is an explanatory view illustrating an example of a paper transport control flow in a synchro (tracing) control in the present embodiment and an example of a paper transport control flow in a simultaneous driving control. An upper part of FIG. 8 corresponds to the paper transport control flow in the synchro (tracing) control. A lower part of FIG. 8 corresponds to the paper transport control flow in the simultaneous driving control. Moreover, in FIG. 8, the ASF target transport amount in the synchro (tracing) control, in which it is not considered to correct the transport amount, is shown for the purpose of easy understanding. That is, the ASF target transport amount in the synchro (tracing) control is equal to the PF target transport amount. In addition, paper transport controls corresponding to six times are exemplified in FIG. 8. In each of the paper transport controls, the paper transport amount corresponding to 100 steps of the PF rotary encoder 34 is instructed.

In the first paper transport control, the paper transporting processing instruction unit 63 instructs the PF control execution unit 41 of the PF target transport amount corresponding to '100 (steps)' on the basis of an instruction of the paper transport amount. Then, when the actual PF transport amount in the first paper transport control changes to '98' through the paper transport control of the PF control execution unit 41, the PF absolute transport amount 52 changes to '98'. Here, an initial value of the PF absolute transport amount 52 is set to '0', for example.

In the second paper transport control, the paper transporting processing instruction unit 63 instructs the PF control execution unit 41 of a PF target transport amount '102' (accumulated paper transport amount up to this time '200'−PF absolute transport amount 52 up to last time '98'). Then, when the actual PF transport amount in the second paper transport control changes to '99' through the paper transport control of the PF control execution unit 41, the PF absolute transport amount 52 changes to '197 (=98+99)'. The paper transporting processing instruction unit 63 and the PF control execution unit 41 repeat the above processing whenever paper transport control is performed.

In the synchronous driving control shown in the lower part of FIG. 8, the paper transporting processing instruction unit 63 instructs the ASF control execution unit 42 of the ASF target transport amount that is obtained by the same operation processing as for the PF target transport amount instructed to the PF control execution unit 41. That is, the paper transporting processing instruction unit 63 instructs '100' as a first ASF target transport amount and instructs '100' (accumulated paper transport amount up to this time '200'−ASF absolute transport amount 55 up to last time '100') as a second ASF target transport amount.

On the other hand, in the synchro (tracing) control shown in the upper part of FIG. 8, the paper transporting processing instruction unit 63 instructs the ASF control execution unit 42 of an ASF target transport amount equal to the PF target transport amount. That is, the paper transporting processing instruction unit 63 instructs '100' as a first ASF target transport amount and instructs '102' as a second ASF target transport amount.

In the fifth paper transport control shown in FIG. 8, it is assumed that the actual PF transport amount significantly decreases to '60' due to a certain factor. In addition, even if the actual PF transport amount is '60', a so-called back tension is not generated because the value is smaller than the actual ASF transport amount. Moreover, the ASF target transport amount in the fifth paper transport control is set to '141' in the synchro (tracing) control shown in the upper part of FIG. 8 and is set to '100' in the simultaneous driving control shown in the lower part of FIG. 8.

As a result, in the sixth paper transport control of the synchro (tracing) control, a difference between the actual PF transport amount and the actual ASF transport amount is '0' with the sixth one paper transport control. However, in the case of the simultaneous driving control, the difference between the actual PF transport amount and the actual ASF transport amount is '−40'. Thus, in one paper transport control, if the actual PF transport amount becomes extremely greater than the actual ASF transport amount, a state of the print medium P after being transported changes such that the print medium P is pulled between the PF roller 14 and LD roller 11 as compared with a state of the print medium P before being transported. Due to the change in the pulled direction, a so-called back tension that causes the print medium P to be pulled from the PF roller 14 side to the LD roller 11 side acts on the print medium P.

As described above, when the print data for continuous printing is supplied, the ink jet printer 1 according to the present embodiment causes both the LD roller 11 and the PF roller 14 to be driven and a plurality of print media P placed in the rear feed tray 2 to be continuously fed, thereby performing printing. In particular, the ink jet printer 1 according to the present embodiment has the following effects due to the characteristic configuration and operation described above.

In the normal ink jet printer, the same printing operation is always performed on all print media P. Specifically, the paper feed processing instruction unit 62 drives the PF roller 14 and the LD roller 11 in a state where the LD follower roller 12 is pressed against the LD roller 11 by the ASF sub-motor 33 and executes paper feed processing from the rear feed tray 2 to the paper feed standby position and the printing start position. In addition, the paper feed processing instruction unit 62 releases the state where the LD follower roller 12 and the LD roller 11 are pressed against each other before completion of paper feed. The paper transporting processing instruction unit 63 drives the PF roller 14 to execute processing for transporting the print medium P, which is being fed, by a predetermined amount. The paper discharge processing instruction unit 64 drives the PF roller 14 to execute processing for transporting the print medium P, which is being fed, up to the discharge tray.

In contrast, the ink jet printer 1 according to the present embodiment continuously feeds the plurality of print media P on the rear feed tray 2 in the continuous printing. Moreover, during the paper feed processing up to the printing start position, a stop period while the ASF motor 32 is not driven is provided to secure the predetermined gap length between pages. Under the condition described above, the ink jet printer 1 transports the plurality of print media P, which is fed with the gap length between pages, by the synchro (tracing) control.

Accordingly, in the ink jet printer 1 according to the present embodiment, the spacing between the plurality of print media P to be printed can be set to a minimum gap length between pages which is needed for detection of the PE sensor 36. That is, a spacing larger than the minimum gap length between pages is not secured as the spacing between two sheets of print media P that are continuously fed. In addition, during the continuous printing, the LD follower roller 12 and the LD roller 11 are maintained in a state where the LD follower roller 12 and the LD roller 11 are pressed against each other. At this time, since it is not necessary to drive the ASF sub-motor 33 for each print medium P during the continuous printing, a time for a driving control is not necessary. Therefore, total printing time for the plurality of print media P can be reduced as compared with that in the normal ink jet printer. Furthermore, since the state where the LD follower roller 12 and the LD roller 11 are pressed against each other is maintained, it is possible to effectively reduce occurrence of sounds, such as a contact noise, generated when the LD follower roller 12 and the LD roller 11 come in contact and spaced apart from each other.

Particularly in the ink jet printer 1 according to the present embodiment, when driving the PF roller 14 and the LD roller 11 together, the PF roller 14 and the LD roller 11 are driven by the synchro (tracing) control having features shown in FIG. 7. In the synchro (tracing) control, a processing instruction unit, such as the paper transporting processing instruction unit 63, supplies to the ASF control execution unit 42 an ASF target transport amount, which is corrected using a PF target transport amount such that the transport amount is greater than the PF target transport amount. The ASF control execution unit 42 controls driving of the LD roller 11 such that the LD roller 11 stops with the ASF target transport amount greater than the PF target transport amount.

Accordingly, the actual transport amount for the LD roller 11 becomes greater than the actual transport amount for the PF roller 14. As a result, the print medium P after being transported is in a more sagging state than the print medium P before being transported. Furthermore, in a paper transport control, such as one paper transport, it is possible to prevent the actual transport amount for the LD roller 11 from becoming smaller than the actual transport amount for the PF roller 14. It is possible to make a state of the print medium P not changed such that a large back tension does not act on the print medium P before and after the transport.

Further, a processing instruction unit such as the paper transporting processing instruction unit 63 calculates, as a transport amount for the PF roller 14, a transport amount including an accumulated transport amount error in the paper transport control where the print medium P under printing is intermittently transported for a predetermined target paper transport amount and supplies the calculated transport amount, as a PF target transport amount, to the PF control execution unit 41. Accordingly, it is possible to correct a transport amount error of the transport amount for the PF roller 14 in the intermittent paper transport control and the like. It is possible to correct the transport amount error occurring due to the back tension and the like.

In addition, the PF control execution unit 41 of the ink jet printer 1 according to the present embodiment starts driving of the PF roller 14 after the ASF control execution unit 42 starts driving of the LD roller 11. Accordingly, the driving of the LD roller 11 starts before the driving of the PF roller 14 starts, such that the print medium P sags between the PF roller 14 and the LD roller 11 by a transport amount due to the time difference. Even if the transport speed of the PF roller 14 becomes instantaneously faster than that of the LD roller 11 during transport control, the print medium P being transported is maintained in the sagging state. It is possible to prevent a large back tension from acting on the print medium P while the print medium P is being transported. In addition, for example, by causing the PF control execution unit 41 to start driving of the PF roller 14 after the ASF control execution unit 42 starts driving of the LD roller 11, the print medium P stops in a sagging state even in a case where the PF roller 14 stops after the LD roller 11 stops. Since the state of the print medium P changes within a range in the sagging state, it is possible to prevent a large back tension from acting on the print medium P at the time of stopping.

Thus, in the ink jet printer 1 according to the present embodiment, it is possible to prevent a large back tension from acting on the print medium P in the transport control, such as a paper transport control. Accordingly, it becomes difficult that a back tension acts on the print medium P. For this reason, it becomes difficult that the posture of the print medium P with respect to the transport direction 4 changes to cause a slanting transport or the actual transport amount of the print medium P at the time of completion of the transport control is smaller than a target transport amount. It is possible to suppress a decrease in the transporting precision of the print medium P. In addition, it becomes difficult that damage due to a back tension occurs in the print medium P. In addition, it becomes difficult that a pulling sound of the print medium P due to the transport control occurs.

While the embodiment described above is an example of a preferred embodiment of the present invention, the present invention is not limited thereto but various modifications and changes may be made without departing from the spirit and scope of the invention.

In the embodiment described above, for example, the detection value calculation unit 43 stores the transport amount after detection of the PE sensor 36, as the PF transport amount after PE detection 53 and the ASF transport amount after PE detection 56, in the memory 39. In addition to that described above, the detection value calculation unit 43 may also store, for example, a value of the PF absolute transport amount 52 or a value of the ASF absolute transport amount 55 when the PE sensor 36 detects the print medium P in the memory 39.

In the case of the modified example, the PF control execution unit 41 or the ASF control execution unit 42 may subtract the value of the PF absolute transport amount at the time of detection, which is stored in the memory 39, from the PF absolute transport amount 52 stored in the memory 39 and use the result as the same value as the PF transport amount after PE detection 53. Moreover, the PF control execution unit 41 or the ASF control execution unit 42 may subtract the value of the ASF absolute transport amount at the time of detection, which is stored in the memory 39, from the ASF absolute transport amount 55 stored in the memory 39 and use the result as the same value as the ASF transport amount after PE detection 56.

In the embodiment described above, the ink jet printer 1 continuously feeds the plurality of print media P in a case of feeding the plurality of print media P on the rear feed tray 2, for example. In addition, for example, the ink jet printer 1 may continuously feed the plurality of print media P in a case of feeding the plurality of print media P on the front feed tray 3.

The present invention may be appropriately used in an ink jet printer and the like.

What is claimed is:

1. A printing apparatus, including a first roller and a second roller, adapted to transport a plurality of print media on a tray in a transport direction, the second roller disposed at a downstream side of the tray in the transport direction, the first roller disposed at a downstream side of the second roller in the transport direction, the printing apparatus comprising:

a first calculator, operable to calculate a first transport amount for the first roller;

a second calculator, operable to calculate, based on the first transport amount, a second transport amount for the second roller, the second transport amount being greater than the first transport amount;

a first controller, operable to drive a first motor that drives the first roller and to stop the first motor such that the first roller stops with the first transport amount; and a second controller, operable to drive a second motor that drives the second roller when the first controller drives the first motor and to stop the second motor such that the second roller stops with the second transport amount;

wherein the first transport amount includes an accumulated transport amount error in a transport control where the plurality of print medium under printing are intermittently transported with every predetermined target paper transport amount.

2. The printing apparatus according to claim 1, wherein the second roller includes a retard roller for supplying the plurality of print media on the tray to a transport path, and the first roller includes a feed roller for transporting the plurality of print media on the transport path to a printing region.

3. The printing apparatus according to claim 1, wherein the first controller starts to drive the first roller after the second controller starts to drive the second roller.

4. A method of controlling transport of a plurality of print media for continuous printing in which the plurality of print media on a tray are continuously fed by driving both a first motor and a second motor that respectively drive a first roller and a second roller to transport the plurality of print media in a transport direction, the second roller disposed at a downstream side of the tray in the transport direction, the first roller disposed at a downstream side of the second roller in the transport direction, the method comprising:

calculating a first transport amount for the first roller;

calculating, based on the first transport amount, a second transport amount for the second roller, the second transport amount being greater than the first transport amount;

stopping the first motor such that the first roller stops with the first transport amount after starting to drive the first and second rollers; and stopping the second motor such that the second roller stops with the second transport amount after starting to drive the first and second rollers;

wherein the first transport amount includes an accumulated transport amount error in a transport control where the plurality of print medium under printing are intermittently transported with every predetermined target paper transport amount.

* * * * *